US005196291A

United States Patent [19]

Okada et al.

[11] Patent Number: 5,196,291

[45] Date of Patent: * Mar. 23, 1993

[54] SILVER HALIDE PHOTOGRAPHIC MATERIAL

[75] Inventors: Hisashi Okada; Kazunobu Katoh, both of Kanagawa, Japan

[73] Assignee: Fuji Photo Film Co., Ltd., Kanagawa, Japan

[ * ] Notice: The portion of the term of this patent subsequent to Feb. 4, 2009 has been disclaimed.

[21] Appl. No.: 741,190

[22] Filed: Jul. 30, 1991

Related U.S. Application Data

[63] Continuation of Ser. No. 527,906, May 24, 1990, abandoned.

[30] Foreign Application Priority Data

May 24, 1989 [JP] Japan ..... 1-130984

[51] Int. Cl.[5] ..... G03C 1/42

[52] U.S. Cl. ..... 430/264; 430/222; 430/223; 430/544; 430/566; 430/598; 430/599; 430/600; 430/601; 430/603; 430/606; 430/607; 430/610; 430/611; 430/957

[58] Field of Search ..... 430/223, 222, 264, 572, 430/566, 598, 957, 544, 546, 599, 600, 601, 603, 606, 607, 610, 611, 613, 614, 615

[56] References Cited

U.S. PATENT DOCUMENTS

| | | | |
|---|---|---|---|
| 4,332,878 | 4/1981 | Akimura et al. | 430/264 |
| 4,438,193 | 3/1984 | Uemura et al. | 430/505 |
| 4,684,604 | 8/1987 | Harder | 430/375 |
| 4,699,873 | 10/1987 | Takahashi et al. | 430/446 |
| 4,777,118 | 10/1988 | Kitchin et al. | 430/264 |
| 4,914,002 | 4/1990 | Inoue et al. | 430/264 |
| 4,914,003 | 4/1990 | Yagihara et al. | 430/264 |
| 4,939,067 | 7/1990 | Takagi et al. | 430/264 |

FOREIGN PATENT DOCUMENTS

| | | | |
|---|---|---|---|
| 61-213847 | 9/1986 | Japan | 430/598 |
| 62-245263 | 10/1987 | Japan | 430/957 |
| 63-046450 | 2/1988 | Japan | 430/544 |
| 1-072140 | 3/1989 | Japan | 430/569 |

*Primary Examiner*—Marion E. McCamish

*Assistant Examiner*—Janis L. Dote

*Attorney, Agent, or Firm*—Sughrue, Mion, Zinn, Macpeak & Seas

[57] ABSTRACT

A silver halide photographic material which comprises a support having provided thereon at least one light-sensitive emulsion layer, and which contains in said emulsion layer, or at least one other layer, at least one hydrazine derivative, at least one contrast enhancing agent and at least one redox compound capable of releasing a development inhibitor upon being oxidized. The hydrazine derivative is exemplified by compounds represented by the following formula:

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group, or an iminomethylene group; and $A_1$ and $A_2$ both represent a hydrogen atom, or, alternatively, one of them represents a hydrogen atom and the other represents an alkylsulfonyl group, an arylsulfonyl group, or an acyl group. The contrast enhancing agent is exemplified by an amine derivative, an onium derivative, a disulfide derivative or a hydroxymethyl derivative. The redox compound is exemplified by compounds represented by the following formula:

6 Claims, 1 Drawing Sheet

SILVER HALIDE PHOTOGRAPHIC MATERIAL

This is a continuation of application Ser. No. 07/527,906 filed May 24, 1990, now abandoned.

FIELD OF THE INVENTION

The present invention relates to a silver halide photographic material and, more particularly, to a silver halide photographic material which provides a contrasty negative image, which possesses enhanced sensitivity, and which provides good halftone dot properties.

BACKGROUND OF THE INVENTION

A system has been demanded in the field of photomechanical process which would provide photographic light-sensitive materials capable of reproducing an original with good properties and stable processing solutions or to simplify replenishing procedures in order to cope with diversity and complexity of printed matter.

For instance, an original in the step of photographing line subject may comprise a wide variety of images such as photocomposed characters, handwritten characters, illustrations, halftone dot photographs, which are all pasted on a common substrate. Therefore, such an original is composed of various images different from each other in density and line width. A process camera, a photographic light-sensitive material or an image forming process has been highly sought which provides good reproducibility of such originals. On the other hand, in making a printing plate for printing a catalog or a large-sized poster, enlargement (spread) or reduction (choke) of a halftone dot photograph is conventionally employed. However, in making a printing plate by enlarging halftone dots, line number becomes coarser resulting in photograph of unsharp dots. Whereas, in making a printing plate by reducing halftone dots, dots finer than those in the original and having a larger line number/inch than the dots in the original are photographed. Therefore, in order to maintain reproducibility of halftone gradation, an image forming process having greater capabilities has been desired.

As a light source in a process camera, a halogen lamp or a xenon lamp can be used. In order to obtain photographic speed for these light sources, the photographic light-sensitive materials to be exposed to these light sources are usually subjected to orthochromatic sensitization. However, orthochromatically sensitized photographic light-sensitive materials have been found to be more strongly influenced by chromatic aberration in the camera lens. Therefore, these photosensitive materials have a tendency to suffer deterioration of image quality. Further, this deterioration is more likely to occur in the instance of xenon lamp exposure.

As a system meeting the above mentioned demand for an image forming process having greater capabilities, a conventional process involves a lith silver halide light-sensitive material comprising silver chloride (containing silver chloride in an amount of at least 50%) with a hydroquinone developer having an extremely low effective concentration (usually 0.1 mol/liter or less) of sulfite ion for obtaining line images or halftone images with a high contrast and a high photographic density. However, this process has the defect that, since the sulfite ion concentration in the developer is low, the developer is extremely unstable against aerial oxidation. Therefore, in order to maintain stable development activity thereof, various efforts and techniques have been made to contend with this problem. However, processing speed is so slow due to these various efforts that a reduced working efficiency results.

Therefore, an image forming system has been desired which solves the problem of unstable image formation in the above described developing process (lith developing system) and which can provide ultra-contrasty photographic properties when developed with a processing solution having a good storage stability. As one system, a proposed process involves a surface latent image forming silver halide photographic material containing a specific acylhydrazine compound with a developer having a pH of 11.0 to 12.3, containing 0.15 mol/liter or more of a sulfite preservative and having a good storage stability to thereby form an ultra-contrasty negative image of a gamma of more than 10 as disclosed, for example, in U.S. Pat. Nos. 4,166,742, 4,168,977, 4,221,857, 4,224,401, 4,243,739, 4,272,606 and 4,311,781. This image forming system is characterized in that, while only silver chlorobromide having a high silver chloride content has been usable for conventional processes for forming ultra-contrasty images, it permits the use of silver bromoiodide or silver chlorobromoiodide.

The above described image forming system is excellent in that it provides sharp halftone dot quality, good processing stability, rapid processing speed and good reproducibility of an original. However, in order to cope with the diversity of recent printed matter, a system providing even more improved reproducibility of an original has been desired.

Towards this goal, it has already been proposed to achieve adequate working efficiency in gathering work and contact work by working under a brighter environment, and development of a plate making light-sensitive material capable of being handled in an environment of a substantially bright room and an exposing printer.

In the present invention, the light-sensitive material capable of being handled in a bright room means a light-sensitive material which can be safely used for an extended period of time under a light not containing ultraviolet component and having a wavelength of substantially 400 nm or longer as a safe light.

The light-sensitive material capable of being handled in a bright room and to be used in gathering work and contact work is a light-sensitive material, which is utilized for conducting negative image/positive image conversion or positive image/positive image conversion, by subjecting the light-sensitive material adapted for contact work to contact exposure using as an original a film having character image or halftone dot image formed by development processing. Such light-sensitive materials are required to possess:

(1) properties such that a halftone dot image and a line or character image can be converted from a negative image to a positive image according to the halftone dot area and line width or character image width, respectively; and (2) properties such that the tone of the halftone dot image and width of character or line image can be adjusted.

Light-sensitive materials capable of being subjected to contact work in a bright room have been proposed as such light-sensitive materials.

However, in a sophisticated image converting work of forming white-on-black character image by superimposition contact work, the above mentioned conventional process by contact work in a bright room using light-sensitive materials adapted for being handled in a bright room has the drawback that, in comparison with a conventional process by contact work in a dark room using light-sensitive materials adapted for being handled in a dark room, a white-on-black character image with deteriorated quality results.

The process of forming a white-on-black character image by superimposition contact work is described in more detail below. As is shown in FIG. 1, a film (b) on which a character or line image is formed (line image original) and a film (d) on which a halftone dot image is formed (halftone dot original) are superposed on transparent or translucent stripping bases (a) and (c) (usually, polyethylene terephthalate films having a thickness of about 100 μm), respectively, to prepare an original, and the halftone dot original (d) of this original is brought into a close contact with the emulsion surface of a light-sensitive material for contact work (e), followed by exposure of the assembly.

After the exposure, the light-sensitive material is subjected to development processing to form a white-on-black portion of line image in a halftone dot image.

In this process of forming white-on-black character images, it is ideal that negative image/positive image conversion can be conducted in accordance with halftone dot area of the halftone dot original and line width of the line image original. However, as is clear from FIG. 1, while the halftone dot original is directly brought into a close contact with the emulsion surface of the light-sensitive material for contact work upon exposure, the line image original (b) is spaced from the light-sensitive material by the stripping base (c) and the halftone dot original (d) upon exposure.

Therefore, when exposed in a sufficient amount to conduct negative image/positive image conversion with high fidelity, line width of white-on-black portion in the line image is narrowed because of out-of-focus exposure of the line image original (b) due to the presence of the spacer of the stripping base (c) and the halftone dot original (d).

JP-A-62-80640 (the term "JP-A" as used herein refers to a "published unexamined Japanese patent application"), JP-A-62-235938, JP-A-62-235939, JP-A-63-104046, JP-A-63-103235, JP-A-63-296031, JP-A-63-314541 and JP-A-64-13545 disclose systems of using hydrazine for solving the above described problem. However, the systems are still insufficient, and more improved systems are desirable.

As an attempt to improve image quality, JP-A-61-213847, for example, discloses a process of silver-image-wise releasing of a development inhibitor from a carbonyl group-containing redox compound, and JP-A-64-72144, for example, discloses a process of silver-image-wise releasing of a development inhibitor from a hydrazine compound. The above described processes are effective in the instance of making halftone gradation less contrasty, but are insufficient in obtaining contrasty halftone dot image and low contrast halftone gradation for the purpose of obtaining a more contrasty image.

Therefore, it has been desired to develop a light-sensitive material which can provide a contrasty halftone dot image by using a stable developer and which permits tone control of image over a wide range.

In addition, in order to obtain contrasty halftone dot image, JP-A-56-106244, JP-A-61-230145, JP-A-62-211647, JP-A-63-503247, for example, disclose addition of amine compounds to a developer. However, developers containing these amine compounds are insufficient for the goal of enhancing stability of the developer or minimizing change in photographic properties due to the change in developer formulation (e.g., pH or sodium sulfite content).

SUMMARY OF THE INVENTION

An object of the present invention is to provide a photographic light-sensitive material which has a broad exposure latitude in photographing line images, and which provides an ultra-contrasty (particularly a gamma value of 10 or more) image having a high resolving power.

Another object of the present invention is to provide a photographic light-sensitive material which can reproduce line image well and which provides an ultra-contrasty image having a high background density (Dmax).

A further object of the present invention is to provide an ultra-contrasty photographic light-sensitive material which has a broad exposure latitude in photographing halftone dot image, and which provides excellent halftone dot quality of high density and clearly outlined, regularly shaped halftone dots.

Still a further object of the present invention is to provide a silver halide photographic light-sensitive material which suffers less changes in photographic properties due to changes in developer formulation.

These and other objects of the present invention will become apparent from the following description below.

The above described and other objects of the present invention are attained by a silver halide photographic material which contains at least one hydrazine derivative, at least one contrast enhancing agent and at least one redox compound capable of releasing a development inhibitor upon being oxidized.

BRIEF DESCRIPTION OF THE DRAWING

FIG. 1 schematically shows the method of testing the formation of a white-on-black character image wherein:

Figures 1A, 1B, 1C, 1D, 1E:
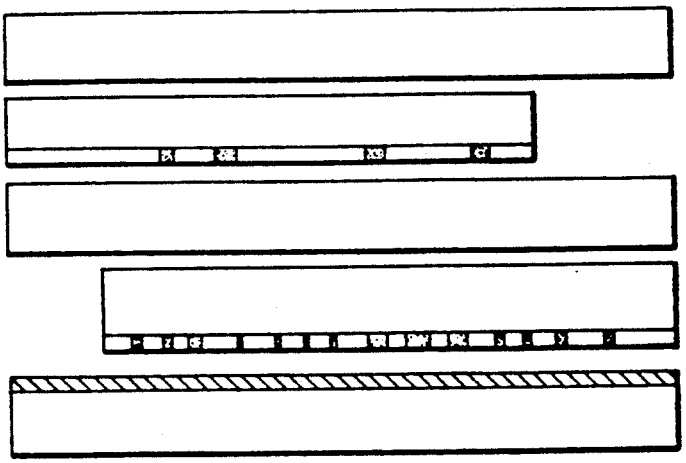

(a) represents a transparent or translucent stripping base;

(b) represents a line image original (black portions showing a line image);

(c) represents a transparent or translucent stripping base;

(d) represents a halftone dot original (black portions showing halftone dots); and (e) represents a light-sensitive material adapted for contact work (the hatched portion showing a light-sensitive layer).

DETAILED DESCRIPTION OF THE INVENTION

The hydrazine derivatives, contrast enhancing agents, and redox compounds are described in detail below.

Suitable preferred hydrazine derivatives are those which are represented by the following formula (I):

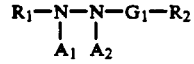

$$R_1-\underset{\underset{A_1}{|}}{N}-\underset{\underset{A_2}{|}}{N}-G_1-R_2 \quad (I)$$

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group,

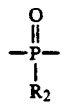

or an iminomethylene group; and $A_1$ and $A_2$ both represent a hydrogen atom, or one of $A_1$ and $A_2$ represents a hydrogen atom and the other represents a substituted or unsubstituted alkylsulfonyl group, a substituted or unsubstituted arylsulfonyl group, or a substituted or unsubstituted acyl group.

In formula (I), the aliphatic group represented by $R_1$ is preferably an aliphatic group containing 1 to 30 carbon atoms, and is particularly a straight chain, branched or cyclic alkyl group containing 1 to 20 carbon atoms. The branched alkyl group may be cyclized so that a heterocyclic ring containing one or more hetero atoms may be formed. This alkyl group may be substituted by a substituent such as an aryl group, an alkoxy group, a sulfoxy group, or a sulfonamido group.

In formula (I), the aromatic group represented by $R_1$ is a monocyclic or bicyclic aryl group or an unsaturated heterocyclic group. The unsaturated heterocyclic group may be fused with a monocyclic or bicyclic aryl group to form a hetero aryl group.

For example, $R_1$ can represent a benzene ring, a naphthalene ring, a pyridine ring, a pyrimidine ring, an imidazole ring, a pyrazole ring, a quinoline ring, an isoquinoline ring, a benzimidazole ring, a thiazole ring, and a benzothiazole ring, with those groups which contain a benzene ring being preferred.

A particularly preferable example of $R_1$ is an aryl group.

The aryl group or unsaturated heterocyclic group represented by $R_1$ may further be substituted. Typical examples of the substituents include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a phosphoric acid amido group, a diacylamino group and an imido group. Preferable substituents are a straight, branched or cyclic alkyl group (containing preferably 1 to 20 carbon atoms), an aralkyl group (preferably a monocyclic or bicyclic one containing 1 to 3 carbon atoms in the alkyl moiety), an alkoxy group (containing preferably 1 to 20 carbon atoms), a substituted amino group (preferably an amino group substituted by an alkyl group or groups containing 1 to 20 carbon atoms), an acylamino group (containing preferably 2 to 30 carbon atoms), a sulfonamido group (containing preferably 1 to 30 carbon atoms), a ureido group (containing preferably 1 to 30 carbon atoms), a phosphoric acid amido group (containing preferably 1 to 30 carbon atoms), etc.

The alkyl group represented by $R_2$ in formula (I) is an alkyl group containing preferably 1 to 4 carbon atoms and may have a substituent or substituents such as a halogen atom, a cyano group, a carboxy group, a sulfo group, an alkoxy group, a phenyl group and a sulfonyl group.

The aryl group represented by $R_2$ in formula (I) is preferably a monocyclic or bicyclic aryl group including, for example, a benzene ring. This aryl group may be substituted, for example, by a halogen atom, an alkyl group, a cyano group, a carboxyl group, a sulfo group, or a sulfonyl group.

The alkoxy group represented by $R_2$ in formula (I) is preferably an alkoxy group containing 1 to 8 carbon atoms which are optionally substituted, for example, by a halogen atom or an aryl group.

The aryloxy group represented by $R_2$ in formula (I) is preferably monocyclic, and substituents therefor include a halogen atom, etc.

The amino group represented by $R_2$ in formula (I) is preferably an unsubstituted amino group, an alkylamino group containing 1 to 10 carbon atoms or an arylamino group, and may be substituted, for example, by an alkyl group, a halogen atom, a cyano group, a nitro group, or a carboxy group.

The carbamoyl group represented by $R_2$ in formula (I) is preferably an unsubstituted carbamoyl group, an alkylcarbamoyl group containing 1 to 10 carbon atoms or an arylcarbamoyl group, and may be substituted, for example, by an alkyl group, a halogen atom, a cyano group or a carboxy group.

The oxycarbonyl group represented by $R_2$ in formula (I) is preferably an alkoxycarbonyl group containing 1 to 10 carbon atoms or an aryloxycarbonyl group, and may be substituted, for example, by an alkyl group, a halogen atom, a cyano group or a nitro group.

When $G_1$ is a carbonyl group, $R_2$ preferably represents, for example, a hydrogen atom, an alkyl group (e.g., methyl, trifluoromethyl, 3-hydroxypropyl, 3-methanesulfonamidopropyl, phenylsulfonamidopropyl or phenylsulfonylmethyl), an aralkyl group (e.g., o-hydroxybenzyl), an aryl group (e.g., phenyl, 3,5-dichlorophenyl, o-methanesulfonamidophenyl or 4-methanesulfonylphenyl), for example, with a hydrogen atom being particularly preferable.

When $G_1$ is a sulfonyl group, $R_2$ preferably represents, for example, an alkyl group (e.g., methyl), an aralkyl group (e.g., o-hydroxyphenylmethyl), an aryl group (e.g., phenyl) or a substituted amino group (e.g., dimethylamino).

When $G_1$ is a sulfoxy group, $R_2$ preferably represents, for example, a cyanobenzyl group or a methylthiobenzyl group and, when $G_1$ represents

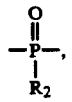

$R_2$ preferably represents a methoxy group, an ethoxy group, a butoxy group, a phenoxy group or a phenyl group, with a phenoxy group being particularly suitable.

When $G_1$ is an N-substituted or unsubstituted iminomethylene group, $R_2$ preferably represents a methyl group, an ethyl group, or a substituted or unsubstituted phenyl group.

As substituents for $R_2$, those mentioned above with respect to $R_1$ may be employed.

$G_1$ in formula (I) is most preferably a carbonyl group.

In addition, $R_2$ may be a group capable of causing the cyclization reaction of eliminating the $—G_1—R_2$ moiety from the molecule to form a cyclic structure containing the $—G_1—R_2$ moiety, specifically, a group represented by the following formula (a):

$$—R_3—Z_1 \quad (a)$$

wherein $Z_1$ represents a group which nucleophilically attacks $G_1$ to split $—G_1—R_3—Z_1$ from the rest of the molecule; and $R_3$ represents a group formed by removing one hydrogen atom from $R_2$, with $Z_1$ nucleophilically attacking $G_1$ to produce a cyclic structure composed of $G_1$, $R_2$ and $Z_1$.

In more detail, $Z_1$ is a group which can easily cause a nucleophilic reaction with $G_1$ when the hydrazine compound of formula (I) produces the following reaction intermediate as a result of, for example, oxidation:

$$R_1—N{=}N—G_1—R_3—Z_1$$

to split $R_1—N{=}N—$ from $G_1$ and which is specifically a functional group capable of directly reacting with $G_1$ such as OH, SH, and $NHR_4$ (wherein $R_4$ represents a hydrogen atom, an alkyl group, an aryl group, $—COR_5$ or $—SO_2R_5$; and $R_5$ represents a hydrogen atom, an alkyl group, an aryl group or a heterocyclic group) or COOH (provided that OH, SH, $NHR_4$ and —COOH may be temporarily protected so that they may be generated by hydrolysis with an alkali or the like), or a functional group such as $$—\overset{\overset{O}{\|}}{C}—R_6 \text{ or } —\overset{\overset{N—R_7}{\|}}{C}—R_6$$

(wherein $R_6$ and $R_7$ each represents a hydrogen atom, an alkyl group, an alkenyl group, an aryl group or a heterocyclic group) which becomes capable of reacting with $G_1$ as a result of reacting with a nucleophilic agent such as hydroxide ion or sulfite ion.

As the ring formed by $G_1$, $R_3$ and $Z_1$, a 5- or 6-membered ring is preferred.

Of the hydrazine derivatives represented by formula (a), preferable ones are represented by formula (b) or (c).

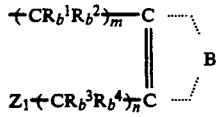

(b)

wherein $R_b^1$, $R_b^2$, $R_b^3$ and $R_b^4$ may be the same or different and each represents, for example, a hydrogen atom, an alkyl group (containing preferably 1 to 12 carbon atoms), an alkenyl group (containing preferably 2 to 12 carbon atoms) or an aryl group (containing preferably 6 to 12 carbon atoms); B represents atoms necessary for completing a 5- or 6-membered ring optionally having a substituent or substituents; and m and n each represents 0 or 1, with (n+m) being 1 or 2.

Examples of the 5- or 6-membered ring formed by B include a cyclohexene ring, a cycloheptene ring, a benzene ring, a naphthalene ring, a pyridine ring and a quinoline ring.

$Z_1$ is the same as defined with respect to formula (a) above.

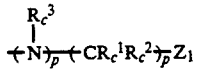

(c)

wherein $R_c^1$ and $R_c^2$ each represents, for example, a hydrogen atom, an alkyl group, an alkenyl group, an aryl group or a halogen atom, and may be the same or different.

$R_c^3$ represents a hydrogen atom, an alkyl group, an alkenyl group or an aryl group.

p represents 0, 1, or 2, and q represents 1 to 4.

$R_c^1$, $R_c^2$ and $R_c^3$ may be bound to each other to form a ring as long as the structure maintains the ability that $Z_1$ can attack $G_1$ intramolecularly and nucleophilically.

Preferable examples of $R_c^1$ and $R_c^2$ include a hydrogen atom, a halogen atom and an alkyl group, and preferable examples of $R_c^3$ include an alkyl group and an aryl group.

q preferably represents 1 to 3, and p represents 1 or 2 when q is 1; p represents 0 or 1 when q is 2, or p represents 0 or 1 when q is 3, provided that, when q represents 2 or 3, the groups ($—CR_c^1R_c^2$) may be the same or different.

$Z_1$ is the same as defined with respect to formula (a) above.

$A_1$ and $A_2$ in formula (I) each preferably represents a hydrogen atom, an alkylsulfonyl group containing 20 or less carbon atoms, an arylsulfonyl group (preferably a phenylsulfonyl group or a phenylsulfonyl group substituted so that sum of the Hammett's substituent constants becomes −0.5 or more), or an acyl group containing 20 or less carbon atoms (preferably a benzoyl group, a benzoyl group substituted so that sum of the Hammett's substituent constants becomes −0.5 or more, or a straight, branched or cyclic, substituted or unsubstituted aliphatic acyl group (examples of substituents being a halogen atom, an ether group, a sulfonamido group, a carbonamido group, a hydroxyl group, a carboxyl group and a sulfonic acid group)).

A hydrogen atom is most preferable as $A_1$ and $A_2$.

$R_1$ or $R_2$ in formula (I) may contain therein a ballast group conventionally used in nondiffusible photographic additives such as couplers. The ballast group is a group which contains 8 or more carbon atoms and which is comparatively inert for photographic properties, and may be selected from, for example, among an alkyl group, an alkoxy group, a phenyl group, an alkylphenyl group, a phenoxy group and an alkylphenoxy group.

$R_1$ or $R_2$ in formula (I) may contain therein a group which strengthens adsorption of the molecule onto the surface of silver halide grains. As such adsorptive group, there may be illustrated, for example, those which are described in U.S. Pat. Nos. 4,385,108, 4,459,347, JP-A-59-195233, JP-A-59-200231, JP-A-59-201045, JP-A-59-201046, JP-A-59-201047, JP-A-59-201048, JP-A-59-201049, JP-A-61-170733, JP-A-61-270744, JP-A-62-948, JP-A-63-234244, JP-A-63-234245 and JP-A-63-234246. Examples of such adsorptive groups include a thiourea group, a heterocyclic thioamido group, a mercapto heterocyclic group and a triazolyl group.

Specific examples of the compounds represented by formula (I) are illustrated below, but the present invention is not to be construed as limited to these examples in any manner.

I-1
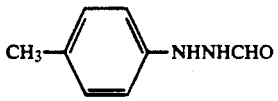
I-2
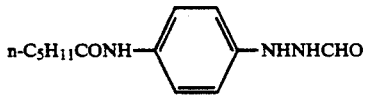
I-3
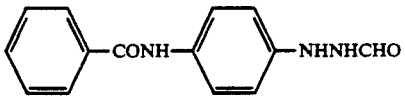
I-4
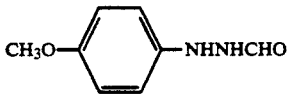
I-5
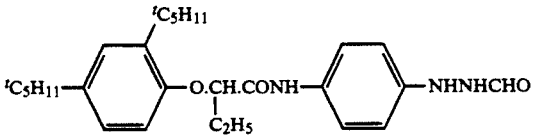
I-6
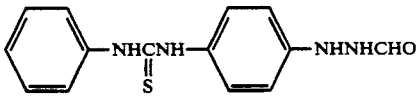
I-7
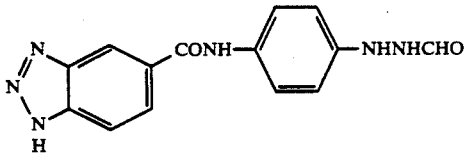
I-8
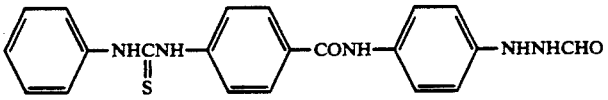
I-9
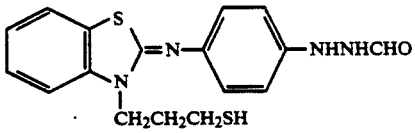
I-10
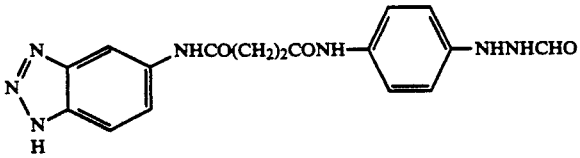
I-11
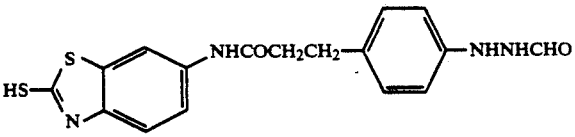

-continued
I-12
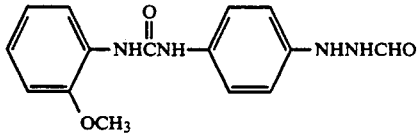
I-13
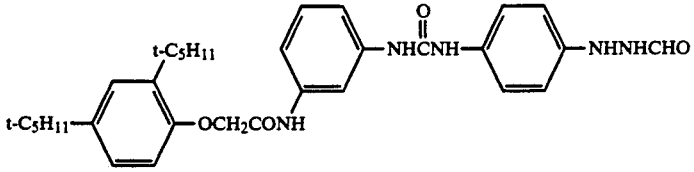
I-14
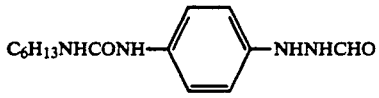
I-15
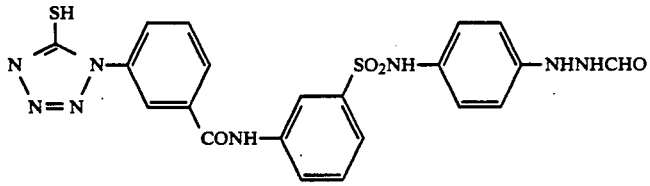
I-16
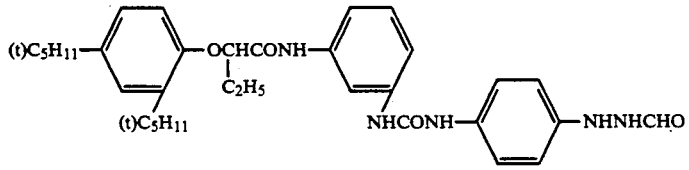
I-17
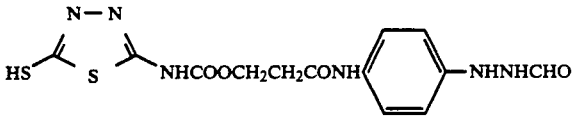
I-18
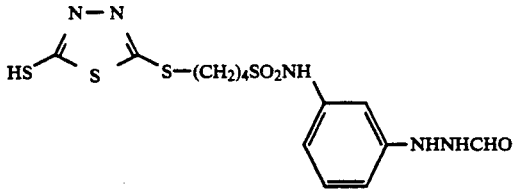
I-19
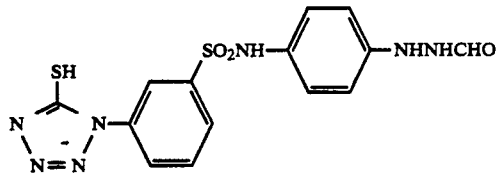
I-20
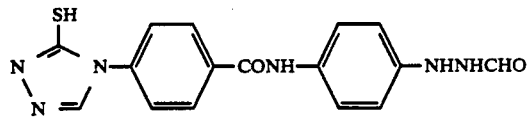

-continued
I-21
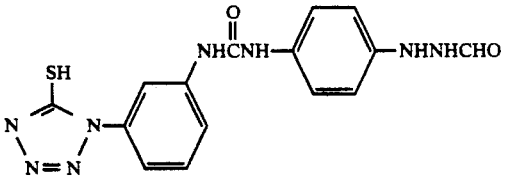
I-22
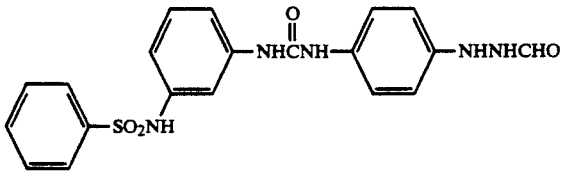
I-23
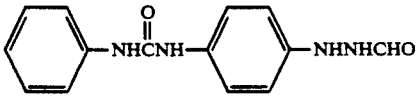
I-24
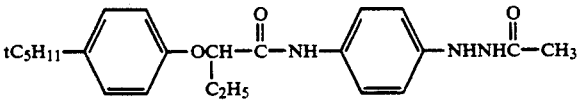
I-25
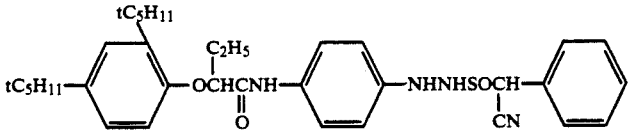
I-26
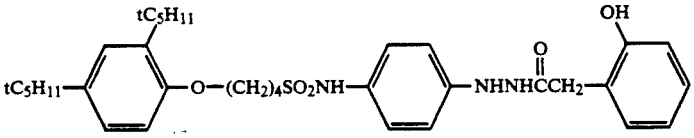
I-27
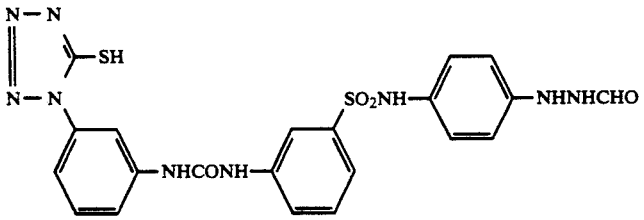
I-28
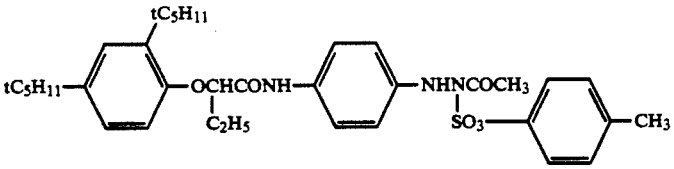
I-29
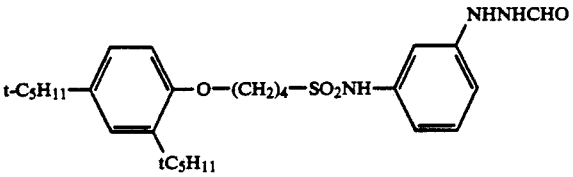
I-30
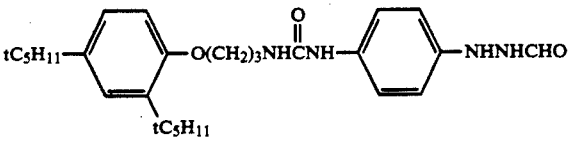

-continued
I-31
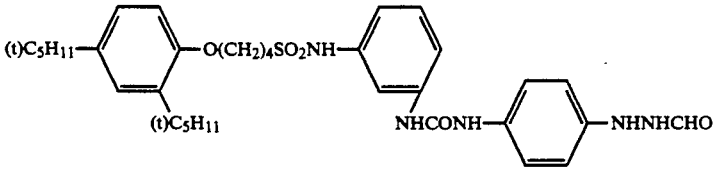
I-32
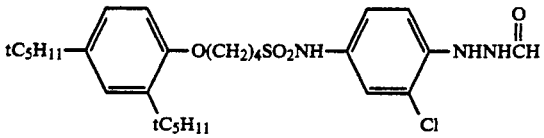
I-33
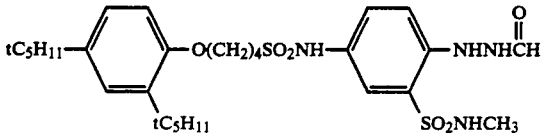
I-34
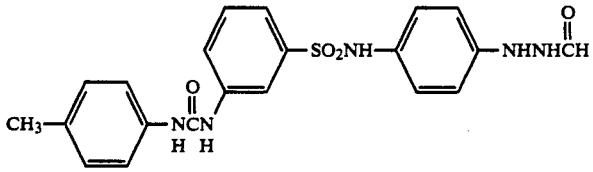
I-35
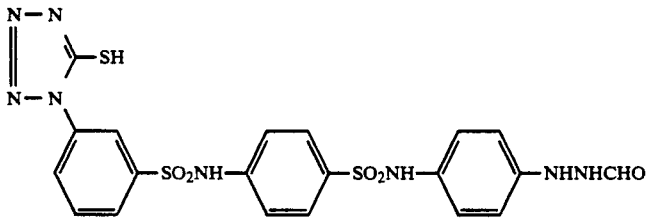
I-36
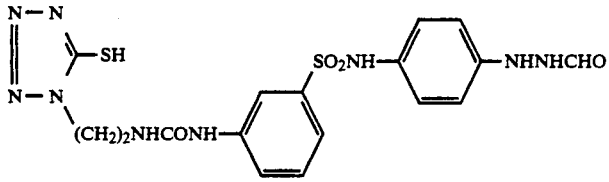
I-37
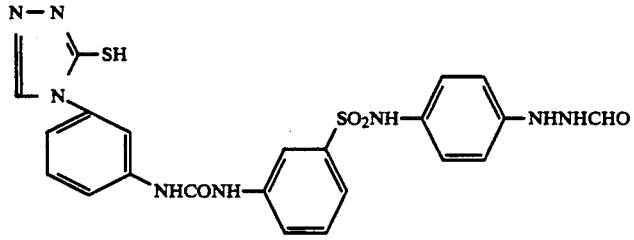
I-38
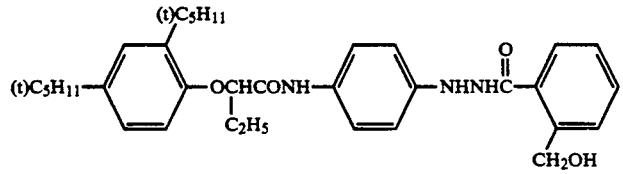

-continued
I-39
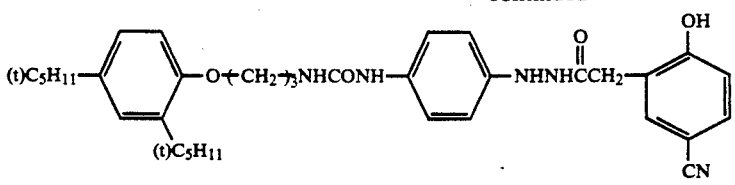
I-40
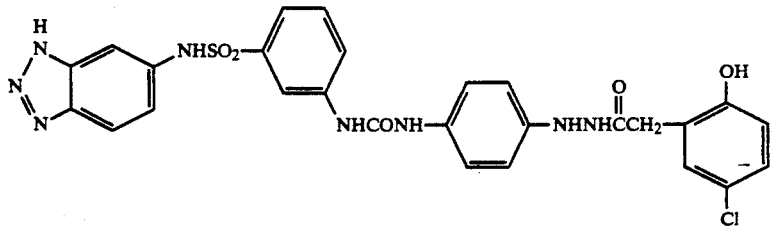
I-41
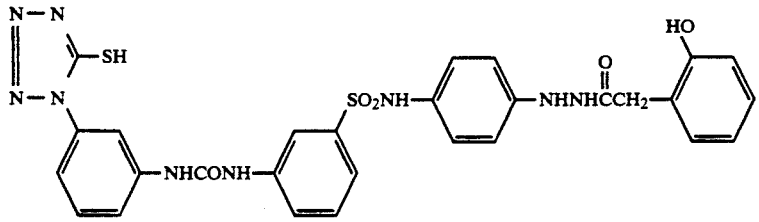
I-42
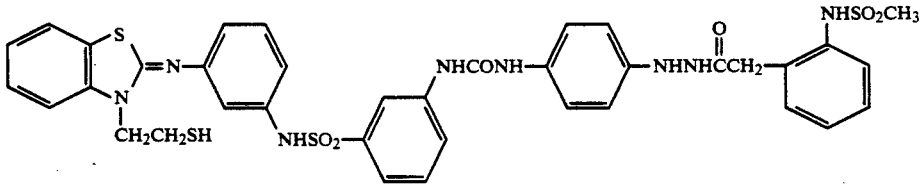
I-43
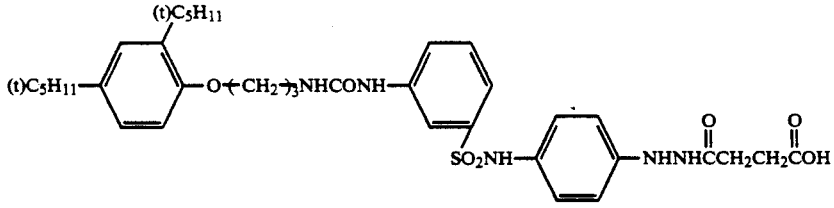
I-44
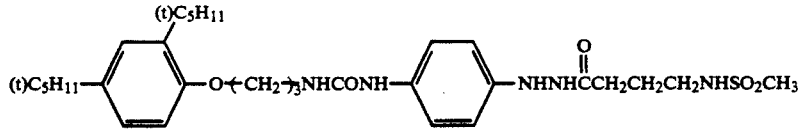
I-45
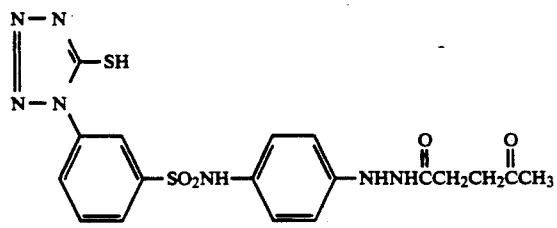
I-46
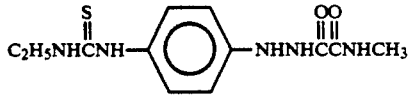

-continued
I-47
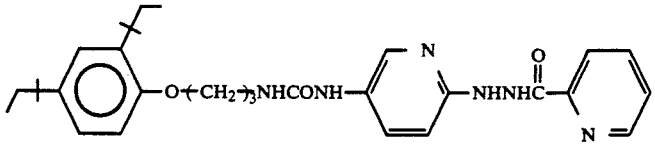
I-48
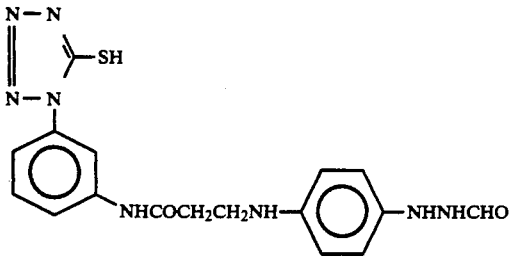
I-49
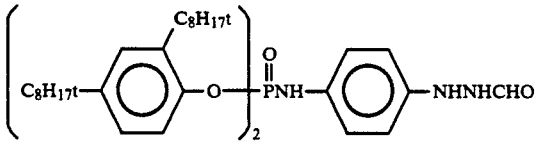
I-50
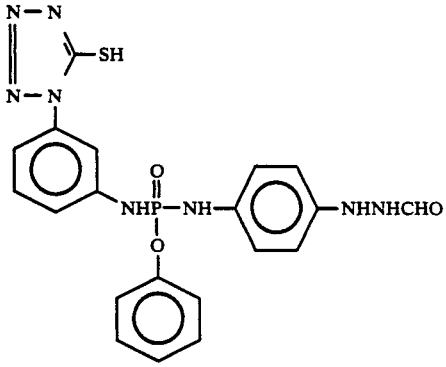
I-51
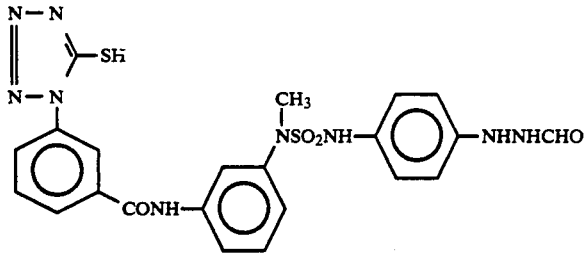
I-52
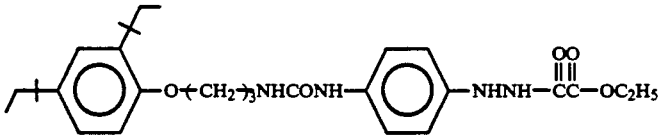
I-53
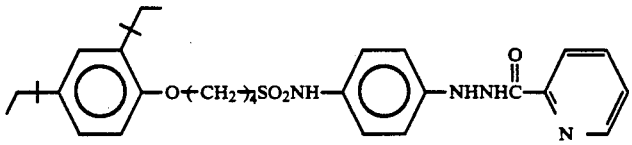

-continued

I-54

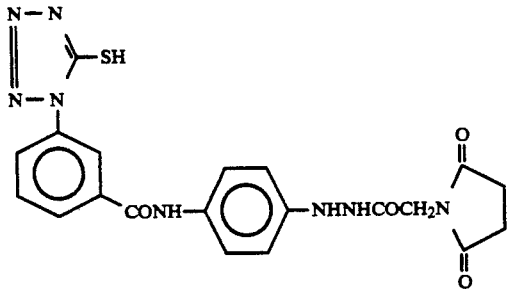

In addition to the specific examples of hydrazine derivatives provided above, other hydrazine derivatives which may be used in the present invention are described in *Research Disclosure*, Item 23516 (November issue, 1983, page 346) and the literature cited therein, and U.S. Pat. Nos. 4,080,207, 4,269,929, 4,276,364, 4,278,748, 4,385,108, 4,459,347, 4,560,638, 4,478,928, British Patent 2,011,391B, JP-A-60-179734, JP-A-62-270948, JP-A-63-29751, JP-A-61-170733, JP-A-61-270744, JP-A-62-948, European Patent 217,310, JP-A-63-32538, JP-A-63-104047, JP-A-63-121838, JP-A-63-129337, JP-A-63-223744, JP-A-63-306448, U.S. Pat. No. 4,686,167, JP-A-62-178246, JP-A-63-234244, JP-A-63-234245,, JP-A-63-234246, JP-A-63-294552, JP-A-1-10233, JP-A-1-90439, JP-A-1-269936, JP-A-1-283548, JP-A-1-280747, JP-A-1-283548, JP-A-1-285940, Japanese Patent Application Nos. 63-147339, 63-179760, 63-229163, 1-18377, 1-18378, 1-18379, 1-15755, 1-16814, 1-40792, 1-42615 and 1-42616.

When incorporating the hydrazine derivative compound of the present invention, as represented by formula (I), into a photographic emulsion layer or a hydrophilic colloidal layer, the compound of the present invention can be dissolved in water or a water-miscible organic solvent (if necessary, an alkali hydroxide or a tertiary amine may be added to form a salt of the compound for dissolution), and then add the resulting solution to a hydrophilic colloid solution (e.g., a silver halide emulsion or a gelatin aqueous solution), and, if necessary, the pH may be adjusted by adding an acid or an alkali.

The hydrazine derivative of the present invention may be used alone or as a combination of two or more of the hydrazine derivatives. The hydrazine derivative is added in an amount of preferably about $1\times10^{-5}$ to about $5\times10^{-2}$ mol, more preferably about $2\times10^{-5}$ to about $1\times10^{-2}$ mol, per mol of silver halide, with an appropriate amount being selected depending upon the properties of a silver halide emulsion to be associated therewith.

As the contrast enhancing agent to be used in the present invention, amine derivatives, onium derivatives, disulfide derivatives and hydroxymethyl derivatives are preferred.

Suitable amine derivatives include, for example, those compounds which are described in JP-A-60-140340, JP-A-62-50829, JP-A-62-222241, JP-A-62-250439, JP-A-62-280733, JP-A-63-124045, JP-A-63-133145 and JP-A-63-286840. More preferable amine derivatives are those compounds which have a group capable of adsorbing onto silver halide grains and which are described in JP-A-63-124045, JP-A-63-133145, JP-A-63-286840, for example, and those compounds which are described in JP-A-62-222241, for example, and which contain a total of 20 or more carbon atoms.

As the onium salts, ammonium salts or phosphonium salts are preferred. Preferable examples of the ammonium salts include those compounds which are described in JP-A-62-250439, JP-A-62-280733, for example. Preferable examples of the phosphonium salts include those compounds which are described in JP-A-61-167939, JP-A-62-280733, for example.

As the disulfide derivatives, examples of these compounds are described in JP-A-61-198147.

As the hydroxymethyl derivatives, examples of these compounds are described in U.S. Pat. Nos. 4,693,956, 4,777,118, European Patent 231,850, JP-A-62-50829, for example, with diarylmethanol derivatives being particularly preferred.

Specific examples of the contrast enhancing agents are illustrated below which, however, are not to be construed to limit the present invention in any way.

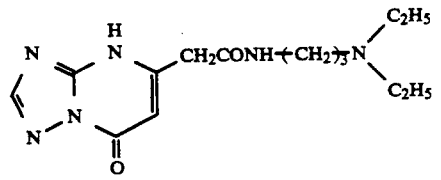

A-1

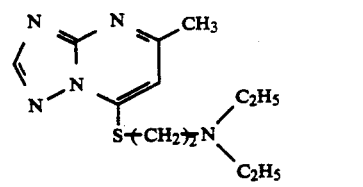

A-2

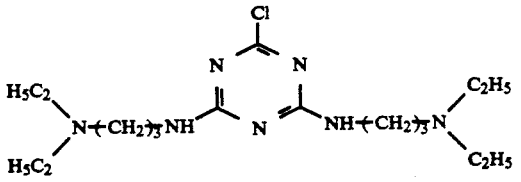

A-3

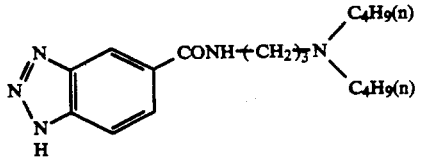

A-4

-continued
A-5
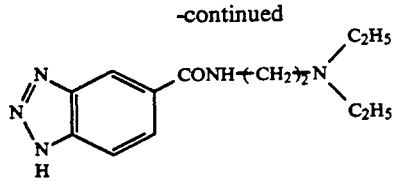
A-6
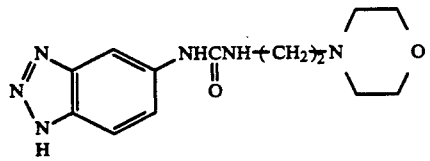
A-7
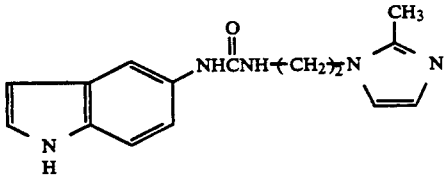
A-8
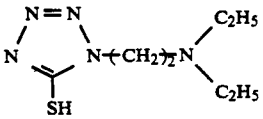
A-9
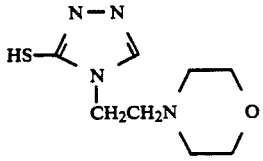
A-10
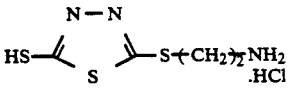
A-11
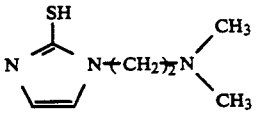
A-12
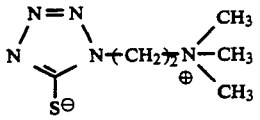
A-13
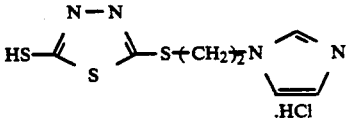
A-14
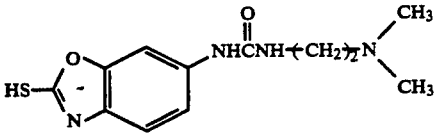
A-15
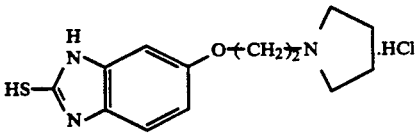
-continued
A-16
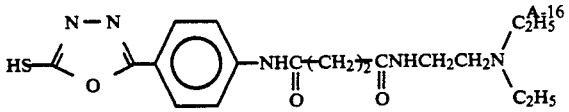
A-17
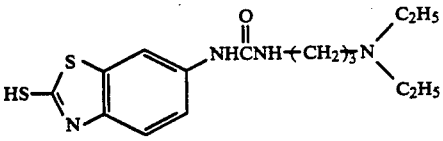
A-18
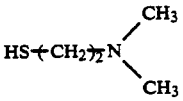
A-19
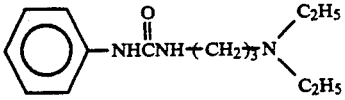
A-20
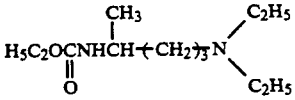
A-21
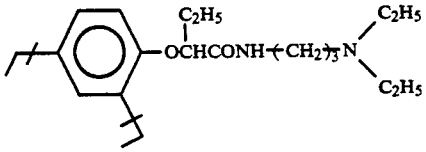
A-22
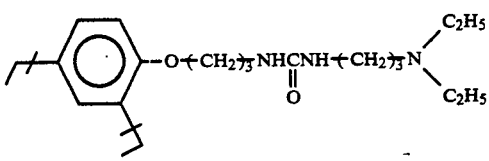
A-23
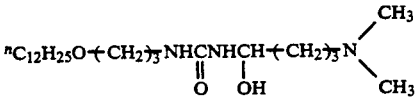
A-24
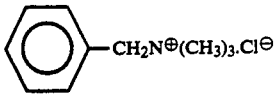
A-25
$^{n}C_{16}H_{33}N^{\oplus}(CH_3)_3.Br^{\ominus}$
A-26
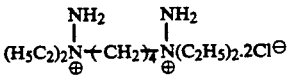
A-27
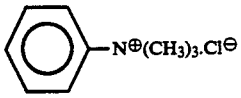
A-28
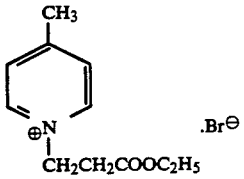

-continued

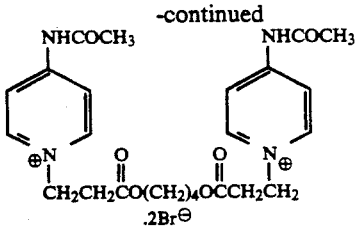

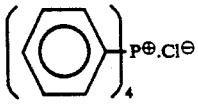

$(^nC_4H_9)_4P^{\oplus}.Br^{\ominus}$

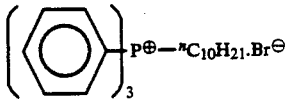

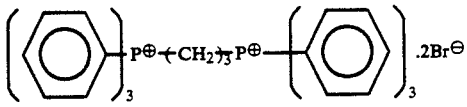

$^nC_4H_9—S—S—^nC_4H_9$

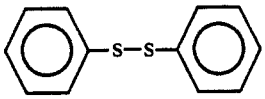

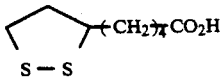

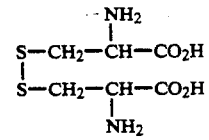

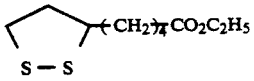

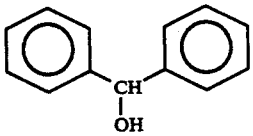

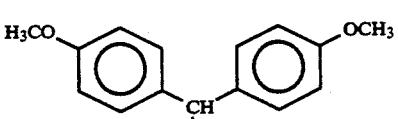

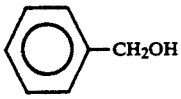

The optimal amounts used of these contrast enhancing agents vary depending upon their kinds, but are desirably about $1.0\times10^{-5}$ mol to about $1.0\times10^{-1}$ mol, preferably about $1.0\times10^{-4}$ mol to about $2.0\times10^{-2}$ mol, per mol of silver halide.

These contrast, enhancing agents are added to a coating solution as a solution in a suitable solvent (e.g., $H_2O$, an alcohol such as methanol or ethanol, acetone, dimethylformamide or methyl cellosolve).

Two or more kinds of these additives may be used in combination.

Examples of the redox group of the redox compound to be used in the present invention and capable of releasing a development inhibitor upon being oxidized include hydroquinones, catechols, naphthohydroquinones, aminophenols, pyrazolidones, hydrazines, hydroxyamines and reductones. Hydrazines are preferable as the redox group, with the compounds of the following formula (II) being more preferable:

$$R—\underset{A_3}{N}—\underset{A_4}{N}—V—(Time)_t—PUG \qquad (II)$$

wherein $A_3$ and $A_4$ both represent a hydrogen atom, or one of them represents a hydrogen atom and the other represents a sulfinic acid residue or $$—\underset{O}{\underset{\|}{(C)_l}}—R_o$$

(wherein $R_0$ represents an alkyl group, an alkenyl group, an aryl group, an alkoxy group or an aryloxy group, l represents 1 or 2), Time represents a divalent linking group, t represents 0 or 1, PUG represents a development inhibitor, V represents a carbonyl group, $$—\underset{O}{\underset{\|}{C}}—\underset{O}{\underset{\|}{C}}—,$$

a sulfonyl group, a sulfoxy group, $$—\overset{O}{\overset{\|}{\underset{R'}{\underset{|}{P}}}}$$

(wherein R' represents an alkoxy group or an aryloxy group), an iminomethylene group or a thiocarbonyl group, and R represents an aliphatic group, an aromatic group or a heterocyclic group.

The redox compounds represented by formula (II) are more particularly described below.

In formula (II), $A_3$ and $A_4$ are exemplified by a hydrogen atom, an alkylsulfonyl or arylsulfonyl group containing 20 or less carbon atoms (preferably a phenylsulfonyl group or a phenylsulfonyl group substituted so that the sum of Hammett's substituent constants becomes −0.5 or more), $$—\underset{O}{\underset{\|}{(C)_l}}—R_o$$

(wherein $R_0$ represents a straight, branched or cyclic alkyl group containing preferably 30 or less carbon atoms, an alkenyl group, an aryl group (preferably a phenyl group or a phenyl group substituted so that the sum of Hammett's substituent constants becomes −0.5 or more), an alkoxy group (e.g., ethoxy), an aryloxy group (preferably monocyclic), for example.), with these groups being optionally further substituted by such substituents as follows. Examples of such substituents include an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, a carboxyl group, an aryloxycarbonyl group, an acyl group, an alkoxycarbonyl group, an acyloxy group, a carbonamido group, a sulfonamido group, a nitro group, an alkylthio group, and an arylthio group. Specific examples of the sulfinic acid residues represented by $A_3$ and $A_4$ are those which are described in U.S. Pat. No. 4,478,928, for example.

Additionally, $A_3$ may be bound to —(Time)$_t$— to be described hereinafter to form a ring.

$A_3$ and $A_4$ most preferably represent a hydrogen atom.

Time represents a divalent linking group, and may have a timing controlling function. The subscript t represents 0 or 1 and, when t =0, PUG is directly bound to V.

The divalent linking group represented by Time represents a group capable of releasing PUG from Time-PUG through one or more reaction steps, said Time-PUG being released from an oxidation product of the oxidation reduction nucleus.

As examples of the divalent linking group represented by Time, there are illustrated, for example, those which are described in U.S. Pat. No. 4,248,962 (JP-A-54-145135), which release a photographically useful group (PUG) by intramolecular cyclizing reaction of p-nitrophenoxy derivative; those which are described in U.S. Pat. Nos. 4,310,612 (JP-A-55-53330) and 4,358,252, for example, which release PUG by intramolecular cyclizing reaction after ring opening; those which are described in U.S. Pat. Nos. 4,330,617, 4,446,216, 4,483,919, and JP-A-59-121328, for example, which release PUG by intramolecular cyclizing reaction of the carboxyl group of succinic acid monoester, or its analog, with production of an acid anhydride; those which are described in U.S. Pat. Nos. 4,409,323, 4,421,845, *Research Disclosure*, No. 21228 (December, 1981), U.S. Pat. No. 4,416,977 (JP-A-57-135944) JP-A-58-209736, JP-A-58-209738, for example, which form quinomonomethane, or its analog, by electron transfer through the double bond conjugated with an aryloxy group or a heterocyclic oxy group to release PUG; those which are described in U.S. Patent 4,420,554 (JP-A-57-136640), JP-A-57-135945, JP-A-57-188035, JP-A-58-98728, JP-A-58-209737, for example, which release PUG from the gamma position of enamine by electron transfer of the moiety having the enamine structure of a nitrogen-containing hetero ring; those which are described in JP-A-57-56837 which release PUG by intramolecular cyclization reaction of the oxy group produced by electron transfer to the carbonyl group conjugated with the nitrogen atom of a nitrogen-containing hetero ring; those which are described in U.S. Pat. No. 4,146,396 (JP-A-52-90932), JP-A-59-93442, and JP-A-59-75475, for example, which release PUG with production of an aldehyde; those which are described in JP-A-51-146828, JP-A-57-179842, and JP-A-59-104641, for example, which release PUG accompanied by decarboxylation of carboxyl group; those which have a structure of -O-COOCR$_a$R$_b$-PUG and which release PUG accompanied by decarboxylation and subsequent production of an aldehyde; those which are described in JP-A-60-7429 which release PUG accompanied by production of isocyanate; and those which are described in U.S. Pat. No. 4,438,193, for example, which release PUG upon coupling reaction with an oxidation product of a color developing agent.

Specific examples of the divalent linking group represented by Time are described in detail, for example, in JP-A-61-236549 and JP-A-1-269936, and preferable specific examples are illustrated below. In the following formulae, (*) represents the position in which -(Time)$_t$-PUG is bound to V, and (*)(*) represents the position in which PUG is bound to Time in formula (II).

T-(1)

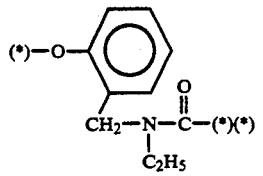

T-(2)

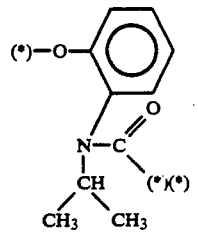

T-(3)

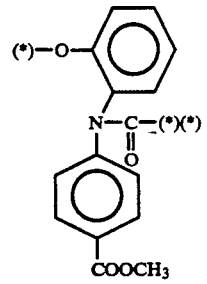

T-(4)

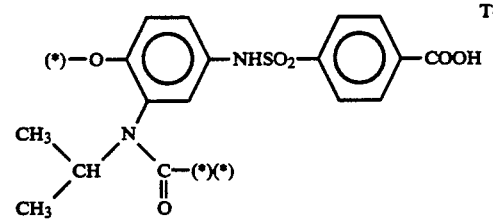

T-(5)

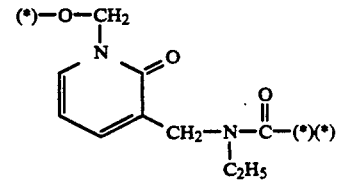

-continued
T-(6)
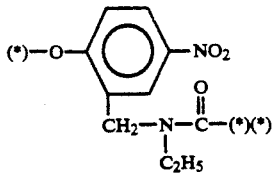
T-(7)
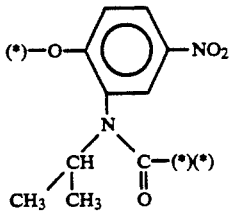
T-(8)
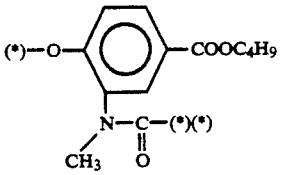
T-(9)
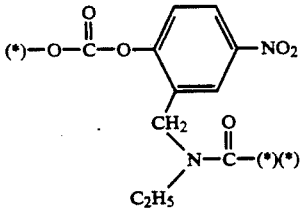
T-(10)
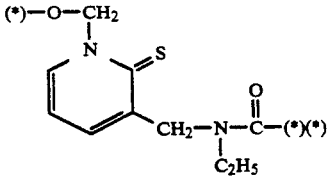
T-(11)
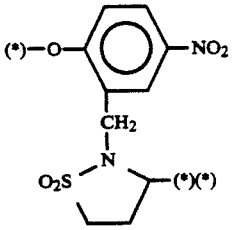
T-(12)
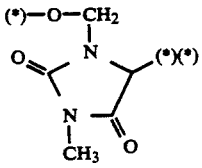
-continued
T-(13)
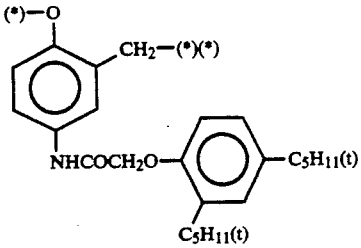
T-(14)
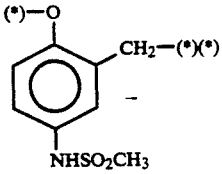
T-(15)
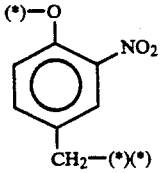
T-(16)
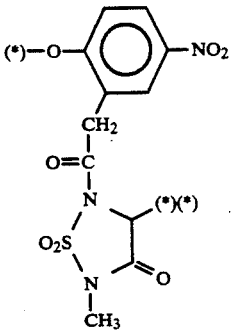
T-(17)
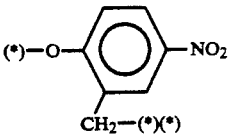
T-(18)
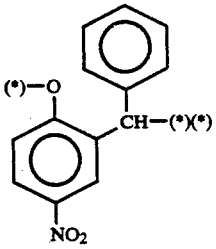
T-(19)
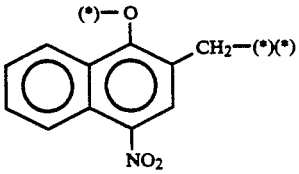

-continued
T-(20)
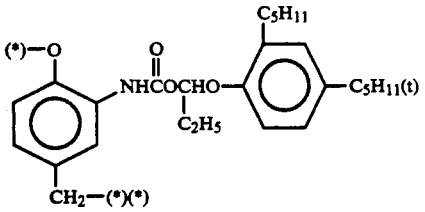
T-(21)
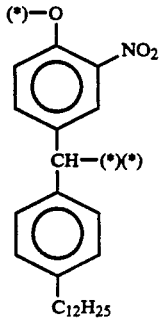
T-(22)
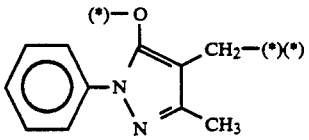
T-(23)
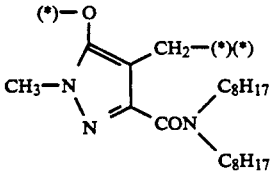
T-(24)
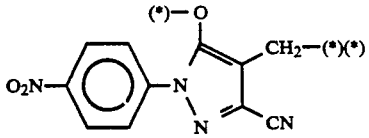
T-(25)
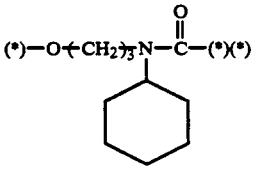
T-(26)
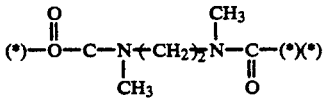
T-(27)
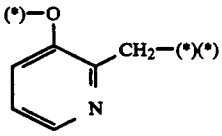
-continued
T-(28)
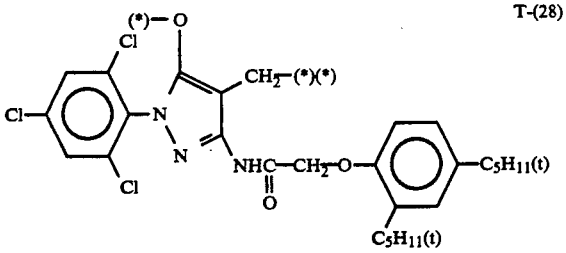
T-(29)
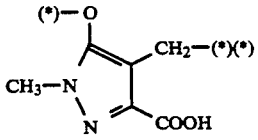
T-(30)
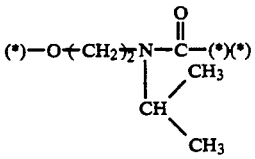
T-(31)
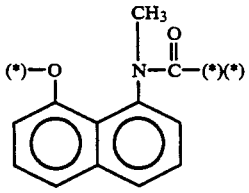
T-(32)
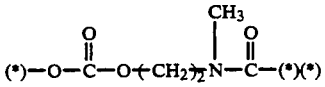
T-(33)
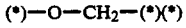
T-(34)
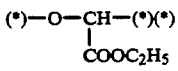
T-(35)
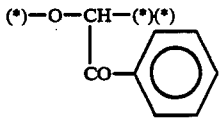
T-(36)
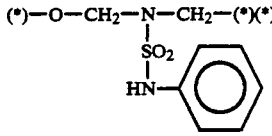
T-(37)
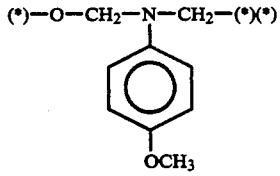
T-(38)
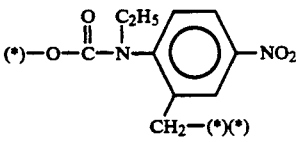

-continued

T-(39)

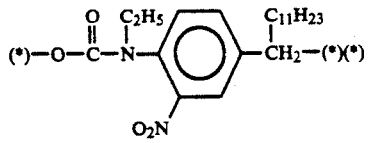

T-(40)

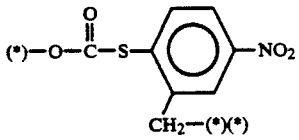

T-(41)

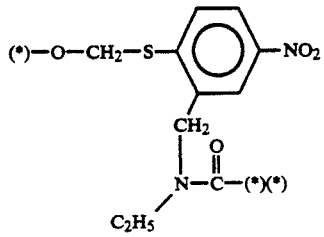

T-(42)

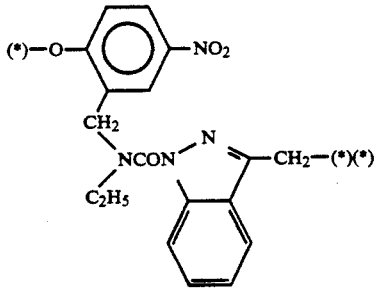

PUG represents a group which has a development inhibiting effect as $(Time)_t$-PUG or PUG.

The development inhibitor represented by PUG or $(Time)_t$PUG is a known development inhibitor containing a hetero atom through which it is bound to the mother nucleus. Examples of the development inhibitors are described, for example, in C.E.K. Mees and T.H. James, *The Theory of Photographic Processes*, 3rd Ed. (published by Macmillan), pp. 344 to 346, for example. Specifically, there are illustrated therein mercaptotetrazoles, mercaptotriazoles, mercaptoimidazoles, mercaptopyrimidines, mercaptobenzimidazoles, mercaptobenzothiazoles, mercaptobenzoxazoles, mercaptothiadiazoles, benzotriazoles, benzimidazoles, indazoles, adenines, guanines, tetrazoles, tetraazaindenes, triazaindenes, mercaptotriazoles, inter alia.

The development inhibitor represented by PUG may be substituted. Examples of the substituents are illustrated below, which may further be substituted.

For example, there are illustrated an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a nitro group, a cyano group, a sulfo group, an alkyloxycarbonyl group, an aryloxycarbonyl group, an acyl group, an alkoxycarbonyl group, an acyloxy group, a carbonamido group, a sulfonamido group, a carboxyl group, a sulfoxy group, a phosphono group, a phosphinico group, a phosphoric acid amido group, inter alia.

Preferable examples of the substituent include a nitro group, a sulfo group, a carboxyl group, a sulfamoyl group, a phosphono group, a phosphinico group and a sulfonamido group.

Main development inhibitors are illustrated below.

A. Mercaptotetrazole Derivatives (1) 1-Phenyl-5-mercaptotetrazole
(2) 1-(4-Hydroxyphenyl)-5-mercaptotetrazole
(3) 1-(4-Aminophenyl)-5-mercaptotetrazole
(4) 1-(4-Carboxyphenyl)-5-mercaptotetrazole
(5) 1-(4-Chlorophenyl)-5-mercaptotetrazole
(6) 1-(4-Methylphenyl)-5-mercaptotetrazole
(7) 1-(2,4-Dihydroxyphenyl)-5-mercaptotetrazole
(8) 1-(4-Sulfamoylphenyl)-5-mercaptotetrazole
(9) 1-(3-Carboxyphenyl)-5-mercaptotetrazole
(10) 1-(3,5-Dicarboxyphenyl)-5-mercaptotetrazole
(11) 1-(4-Methoxyphenyl)-5-mercaptotetrazole
(12) 1-(2-Methoxyphenyl)-5-mercaptotetrazole
(13) 1-[4-(2-Hydroxyethoxy)phenyl]-5-mercaptotetrazole
(14) 1-(2,4-Dichlorophenyl)-5-mercaptotetrazole
(15) 1-(4-Dimethylaminophenyl)-5-mercaptotetrazole
(16) 1-(4-Nitrophenyl)-5-mercaptotetrazole
(17) 1,4-Bis(5-mercapto-1-tetrazolyl)benzene
(18) 1-(α-Naphthyl)-5-mercaptotetrazole
(19) 1-(4-Sulfophenyl)-5-mercaptotetrazole
(20) 1-(3-Sulfophenyl)-5-mercaptotetrazole
(21) 1-(β-Naphthyl)-5-mercaptotetrazole
(22) 1-Methyl-5-mercaptotetrazole
(23) 1-Ethyl-5-mercaptotetrazole
(24) 1-Propyl-5-mercaptotetrazole
(25) 1-Octyl-5-mercaptotetrazole
(26) 1-Dodecyl-5-mercaptotetrazole
(27) 1-Cyclohexyl-5-mercaptotetrazole
(28) 1-Palmityl-5-mercaptotetrazole
(29) 1-Carboxyethyl-5-mercaptotetrazole
(30) 1-(2,2-Diethoxyethyl)-5-mercaptotetrazole
(31) 1-(2-Aminoethyl)-5-mercaptotetrazole Hydrochloride
(32) 1-(2-Diethylaminoethyl)-5-mercaptotetrazole
(33) 2-(5-Mercapto-1-tetrazolyl)ethyltrimethylammonium Chloride
(34) 1-(3-Phenoxycarbonylphenyl)-5-mercaptotetrazole
(35) 1-(3-Maleinimidophenyl)-6-mercaptotetrazole B. Mercaptotriazole Derivatives (1) 4-Phenyl-3-mercaptotriazole
(2) 4-Phenyl-5-methyl-3-mercaptotriazole
(3) 4,5-Diphenyl-3-mercaptotriazole
(4) 4-(4-Carboxyphenyl)-3-mercaptotriazole
(5) 4-Methyl-3-mercaptotriazole
(6) 4-(2-Dimethylaminoethyl)-3-mercaptotriazole
(7) 4-(α-Naphthyl)-3-mercaptotriazole
(8) 4-(4-Sulfophenyl)-3-mercaptotriazole
(9) 4-(3-Nitrophenyl)-3-mercaptotriazole C. Mercaptoimidazole Derivatives (1) 1-Phenyl-2-mercaptoimidazole
(2) 1,5-Diphenyl-2-mercaptoimidazole
(3) 1-(4-Carboxyphenyl)-2-mercaptoimidazole
(4) 1-(4-Hexylcarbamoyl)-2-mercaptoimidazole
(5) 1-(3-Nitrophenyl)-2-mercaptoimidazole
(6) 1-(4-Sulfophenyl)-2-mercaptoimidazole D. Mercaptopyrimidine Derivatives (1) Thiouracil
(2) Methylthiouracil
(3) Ethylthiouracil
(4) Propylthiouracil
(5) Nonylthiouracil
(6) Aminothiouracil
(7) Hydroxythiouracil E. Mercaptobenzimidazole Derivatives (1) 2-Mercaptobenzimidazole
(2) 5-Carboxy-2-mercaptobenzimidazole
(3) 5-Amino-2-mercaptobenzimidazole
(4) 5-Nitro-2-mercaptobenzimidazole
(5) 5-Chloro-2-mercaptobenzimidazole
(6) 5-Methoxy-2-mercaptobenzimidazole
(7) 2-Mercaptonaphthoimidazole
(8) 2-Mercapto-5-sulfobenzimidazole
(9) 1-(2-Hydroxyethyl)-2-mercaptobenzimidazole
(10) 5-Capronamido-2-mercaptobenzimidazole
(11) 5-(2-Ethylhexanoylamino)-2-mercaptobenzimidazole F. Mercaptothiadiazole Derivatives (1) 5-Methylthio-2-mercapto-1,3,4-thiadiazole
(2) 5-Ethylthio-2-mercapto-1,3,4-thiadiazole
(3) 5-(2-Dimethylaminoethylthio)-2-mercapto-1,3,4-thiadiazole
(4) 5-(2-Carboxypropylthio)-2-mercapto-1,3,4-thiadiazole
(5) 2-Phenoxycarbonylmethylthio-5-mercapto-1,3,4-thiadiazole G. Mercaptobenzothiazole Derivatives (1) 2-Mercaptobenzothiazole
(2) 5-Nitro-2-mercaptobenzothiazole
(3) 5-Carboxy-2-mercaptobenzothiazole
(4) 5-Sulfo-2-mercaptobenzothiazole H. Mercaptobenzoxazole Derivatives (1) 2-Mercaptobenzoxazole
(2) 5-Nitro-2-mercaptobenzoxazole
(3) 5-Carboxy-2-mercaptobenzoxazole
(4) 5-Sulfo-2-mercaptobenzoxazole I. Benzotriazole Derivatives (1) 5,6-Dimethylbenzotriazole
(2) 5-Butylbenzotriazole
(3) 5-Methylbenzotriazole
(4) 5-Chlorobenzotriazole
(5) 5-Bromobenzotriazole
(6) 5,6-Dichlorobenzotriazole
(7) 4,6-Dichlorobenzotriazole
(8) 5-Nitrobenzotriazole
(9) 4-Nitro-6-chlorobenzotriazole
(10) 4,5,6-Trichlorobenzotriazole
(11) 5-Carboxybenzotriazole
(12) 5-Sulfobenzotriazole Sodium Salt
(13) 5-Methoxycarbonylbenzotriazole
(14) 5-Aminobenzotriazole
(15) 5-Butoxybenzotriazole
(16) 5-Ureidobenzotriazole
(17) Benzotriazole
(18) 5-Phenoxycarbonylbenzotriazole
(19) 5-(2,3-Dichloropropyloxycarbonyl)benzotriazole J. Benzimidazole Derivatives:

(1) Benzimidazole
(2) 5-Chlorobenzimidazole
(3) 5-Nitrobenzimidazole
(4) 5-n-Butylbenzimidazole
(5) 5-Methylbenzimidazole
(6) 4-Chlorobenzimidazole
(7) 5,6-Dimethylbenzimidazole
(8) 5-Nitro-2-(trifluoromethyl)benzimidazole K. Indazole Derivatives (1) 5-Nitroindazole
(2) 6-Nitroindazole
(3) 5-Aminoindazole
(4) 6-Aminoindazole
(5) Indazole
(6) 3-Nitroindazole
(7) 5-Nitro-3-chloroindazole
(8) 3-Chloro-5-nitroindazole
(9) 3-Carboxy-5-nitroindazole L. Tetrazole Derivatives (1) 5-(4-Nitrophenyl)tetrazole
(2) 5-Phenyltetrazole
(3) 5-(3-Carboxyphenyl)tetrazole M. Tetraazaindene Derivatives (1) 4-Hydroxy-6-methyl-5-nitro-1,3,3a,7-tetraazaindene
(2) 4-Mercapto-6-methyl-5-nitro-1,3,3a,7-tetraazaindene N. Mercaptoaryl Derivatives (1) 4-Nitrothiophenol
(2) Thiophenol
(3) 2-Carboxythiophenol V represents a carbonyl group,

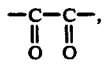

a sulfonyl group, a sulfoxy group,

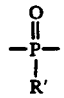

(wherein R′ represents an alkoxy group or an aryloxy group), an iminomethylene group or a thiocarbonyl group, and V preferably represents a carbonyl group.

The aliphatic group represented by R is a straight, branched or cyclic alkyl group, an alkenyl group or an alkynyl group, and contains preferably 1 to 30, more preferably 1 to 20, carbon atoms. The branched alkyl group may be cyclized so as to form a saturated hetero ring containing a hetero atom.

For example, there are illustrated a methyl group, a t-butyl group, an n-octyl group, a t-octyl group, a cyclohexyl group, a hexenyl group, a pyrrolidyl group, a tetrahydrofuryl group and an n-dodecyl group.

The aromatic group is a monocyclic or bicyclic aryl group and is exemplified by a phenyl group or a naphthyl group.

The heterocyclic group is a saturated, or unsaturated, 3- to 10-membered hetero ring containing at least one of N, O and S atoms, may be monocyclic or bicyclic, and may be fused with other aromatic or heterocyclic ring to form a fused ring system. Preferable examples of the heterocyclic group are 5- or 6-membered aromatic hetero rings such as a pyridine ring, an imidazolyl group, a quinolinyl group, a benzimidazolyl group, a pyrimidinyl group, a pyrazolyl group, an isoquinolinyl group, a benzothiazolyl group and a thiazolyl group.

R may be substituted by a substituent or substituents. Examples of the substituents are illustrated below, which may further be substituted.

Examples of the substituents include, for example, an alkyl group, an aralkyl group, an alkenyl group, an alkynyl group, an alkoxy group, an aryl group, a substituted amino group, an acylamino group, a sulfonylamino group, a ureido group, a urethane group, an aryloxy group, a sulfamoyl group, a carbamoyl group, an alkylthio group, an arylthio group, a sulfonyl group, a sulfinyl group, a hydroxy group, a halogen atom, a cyano group, a sulfo group, an alkyloxycarbonyl group, an aryloxycarbonyl group, an acyl group, an alkoxycarbonyl group, an acyloxy group, a carbonamido group, a sulfon- In formula (II), R or -(Time)$_r$-PUG may contain therein a ballast group conventionally used for non-diffusible photographic additives such as couplers or a group capable of promoting adsorption of the compound represented by formula (II) onto silver halide grains.

The ballast group is an organic group giving the compound represented by formula (II) sufficient molecular weight so that the compound substantially does not diffuse into other layers or a processing solution, and the ballast group comprises one or a combination of an alkyl group, an aryl group, a heterocyclic group, an ether group, a thioether group, an amido group, a ureido group, a urethane group, a sulfonamido group, etc. The ballast group is preferably a ballast group containing a substituted benzene ring, with a ballast group containing a benzene ring substituted by a branched alkyl group being particularly preferred.

Specific examples of the group capable of promoting adsorption onto silver halide grains include cyclic thioamido groups such as 4-thiazoline-2-thione, 4-imidazoline-2-thione, 2-thiohydantoin, rhodanine, thiobarbituric acid, tetrazoline-5-thione, 1,2,4-triazoline-3-thione, 1,3,4-oxazoline-2-thione, benzimidazoline-2-thione, benzoxazoline-2-thione, benzothiazoline-2-thione, thiotriazine, 1,3-imidazoline-benzimidazoline-2-thione, benzoxazoline-2-thione, benzothiazoline-2-thione, thiotriazine, 1,3-imidazoline-2-thione, for example, chain thioamido groups, aliphatic mercapto groups, aromatic mercapto groups, heterocyclic mercapto groups (those wherein the carbon atom to which —SH is bound is adjacent to a nitrogen atom are the same as cyclic thioamido groups which are in a relation of tautomerism with them, and specific examples thereof are the same as mentioned above), groups having a disulfido bond, 5- or 6-membered nitrogen-containing heterocyclic groups comprising a combination of nitrogen, oxygen, sulfur and carbon, such as benzotriazole, triazole, tetrazole, indazole, benzimidazole, imidazole, benzothiazole, thiazole, thiazoline, benzoxazole, oxazole, oxazoline, thiadiazole, oxathiazole, triazine, azaindene, for example, and heterocyclic quaternary salts such as benzimidazolinium.

These groups may further be substituted by suitable substituents.

Examples thereof include those which have been mentioned above as substituents for R.

Specific examples of the compounds represented by formula (II) to be used in the present invention are illustrated below, which, however, do not limit the present invention in any way.

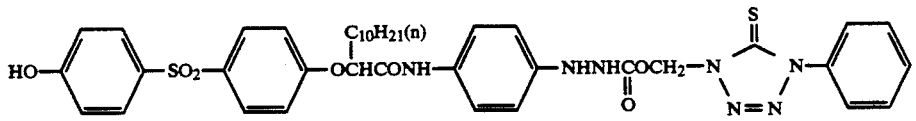

II-1.

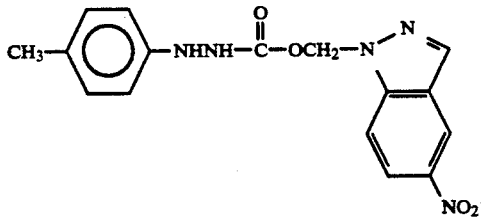

II-2.

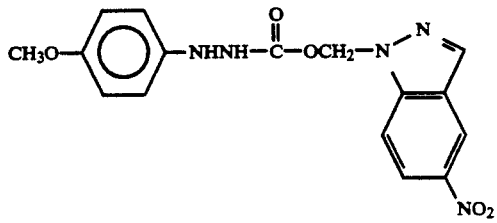

II-3.

-continued
II-4.
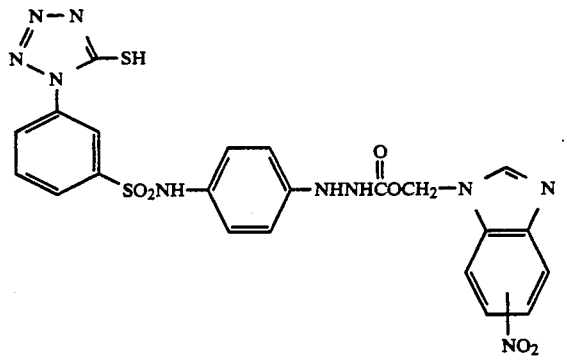
II-5.
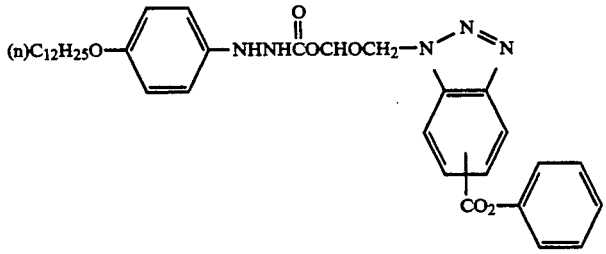
II-6.
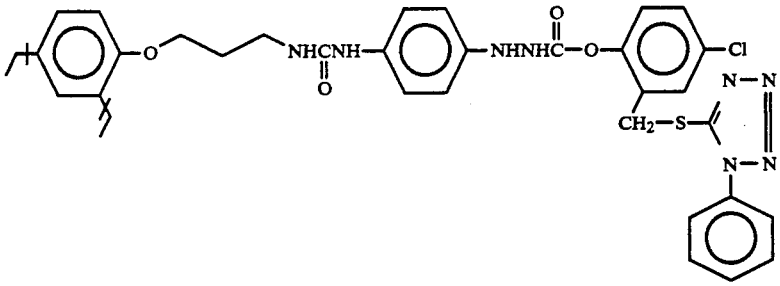
II-7.
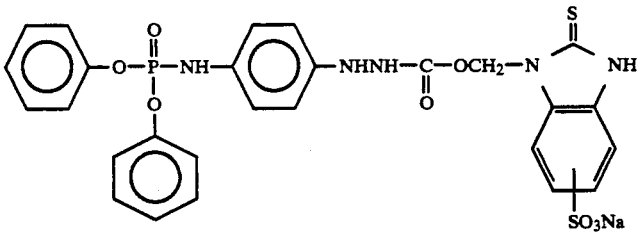
II-8.
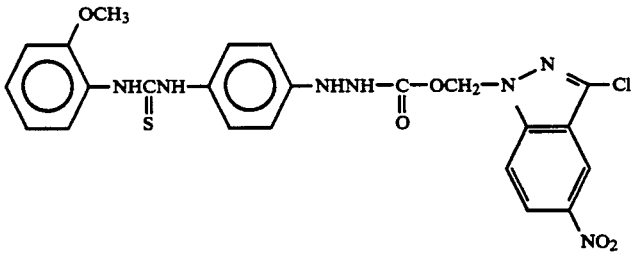
II-9.
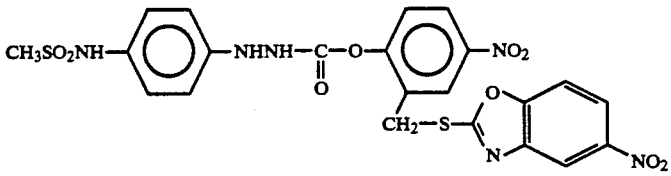

-continued
II-10.
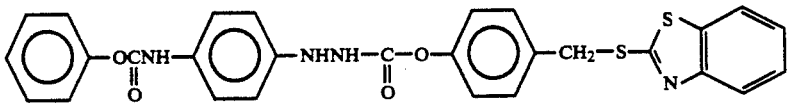
II-11.
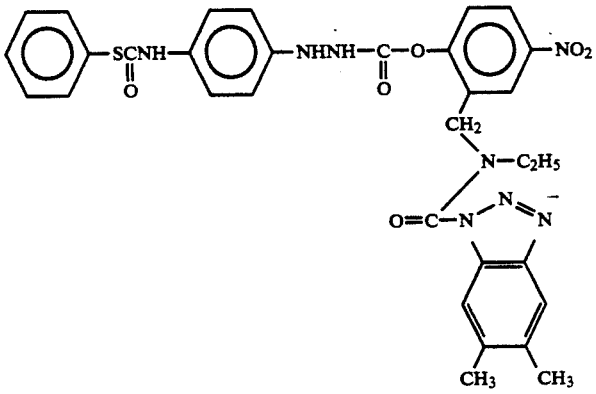
II-12.
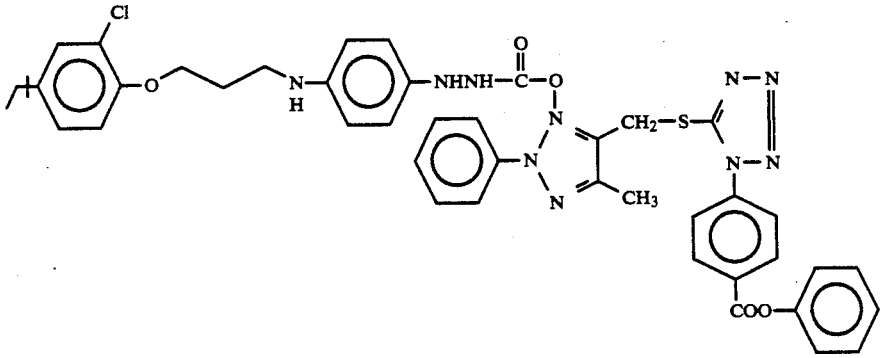
II-13.
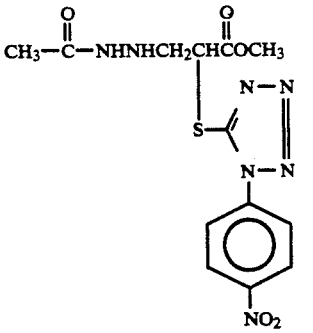
II-14.
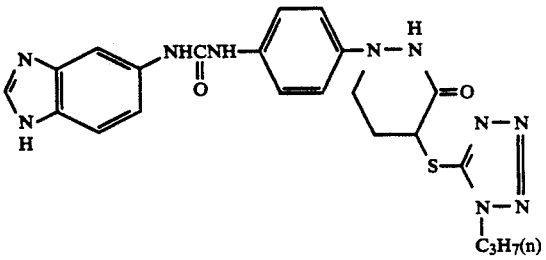

-continued
II-15.
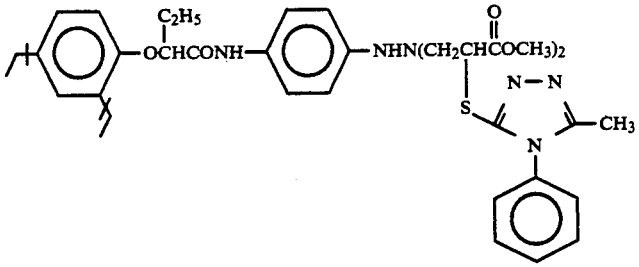
II-16.
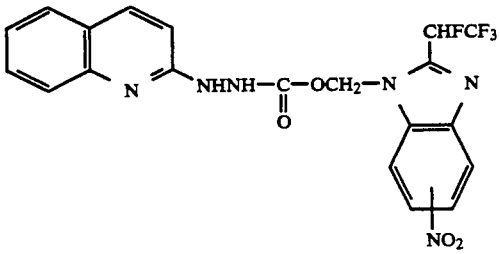
II-17.
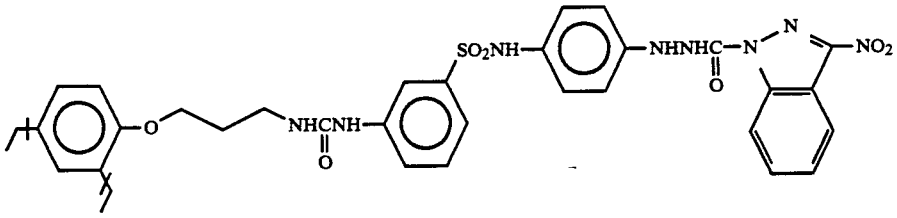
II-18.
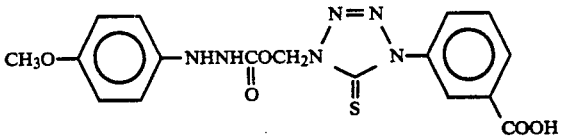
II-19.
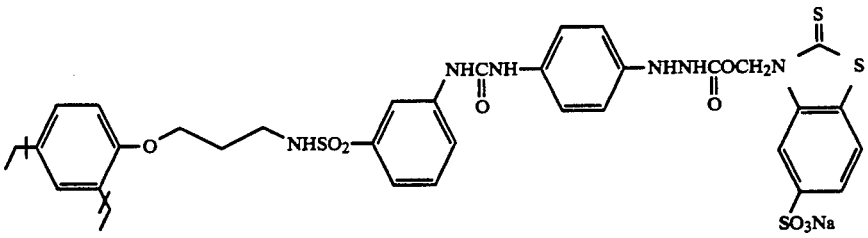
II-20.
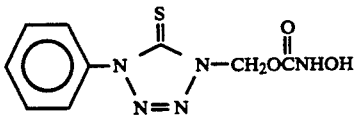
II-21.
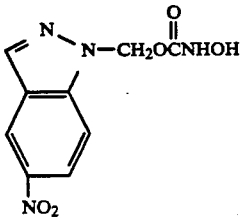

-continued
II-22.
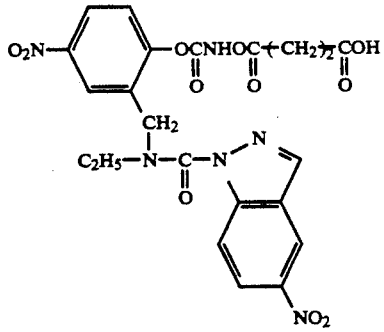
II-23.
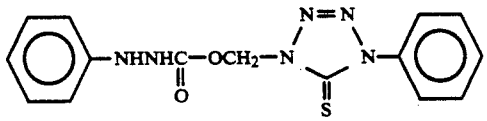
II-24.
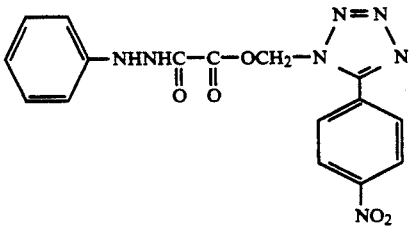
II-25.
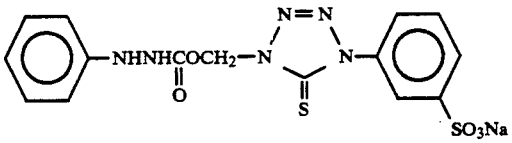
II-26.
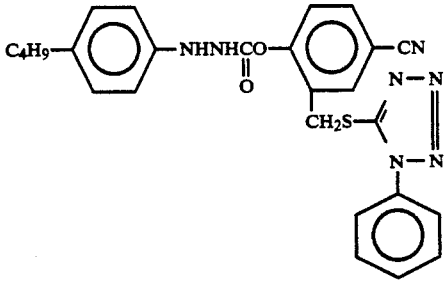
II-27.
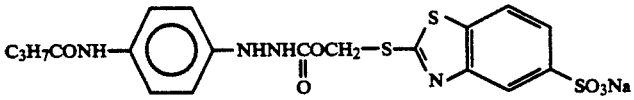
II-28.
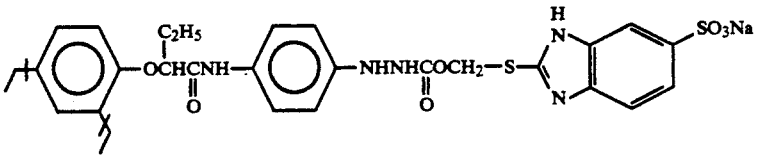

-continued
II-29.
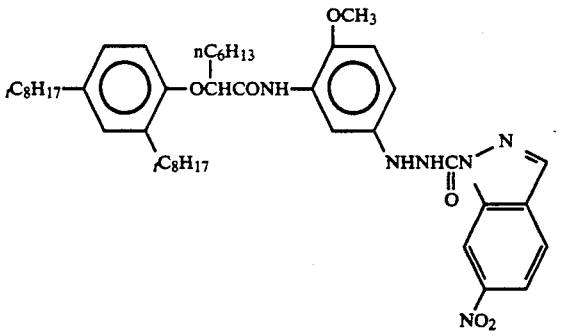
II-30
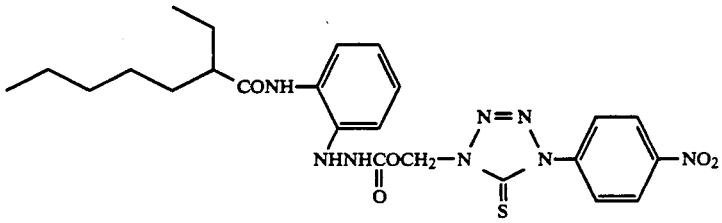
II-31.
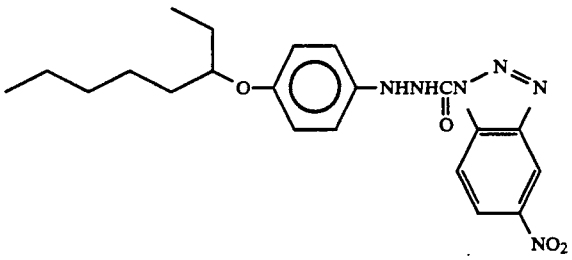
II-32.
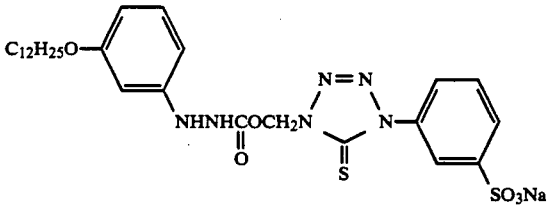
II-33.
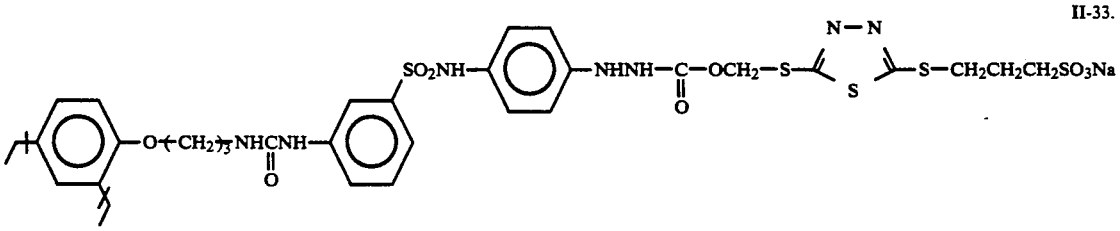
II-34.
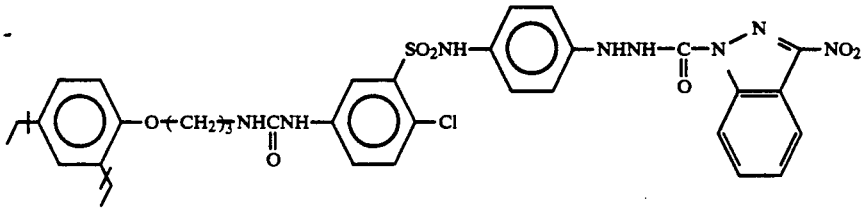

-continued
II-35.
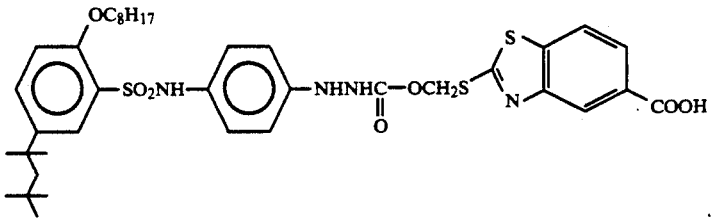
II-36.
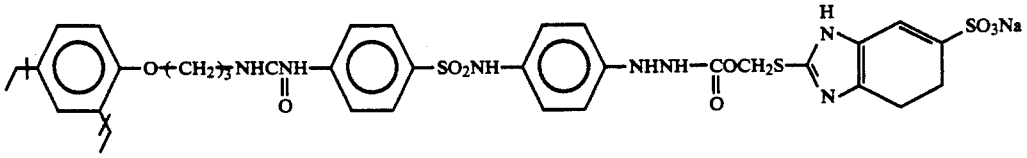
II-37.
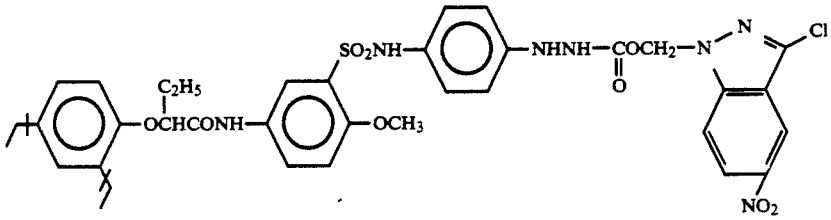
II-38.
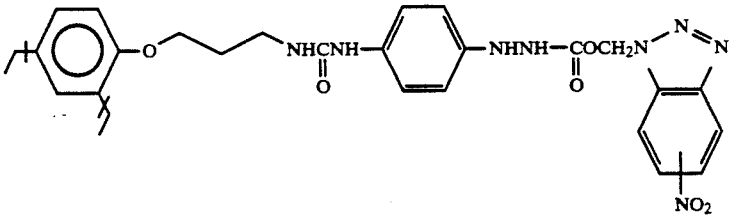
II-39.
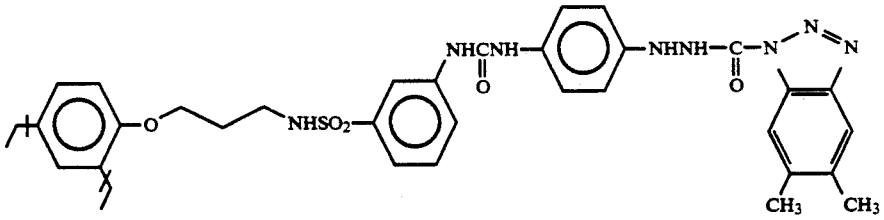
II-40.
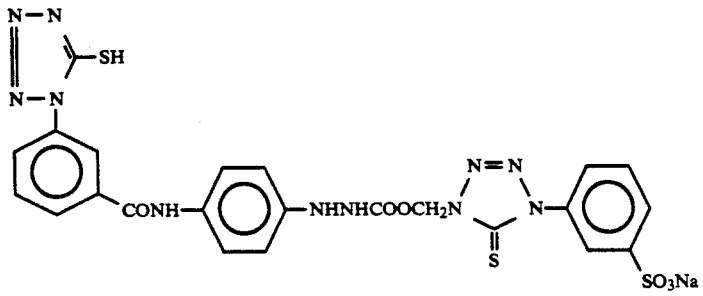

-continued
II-41.
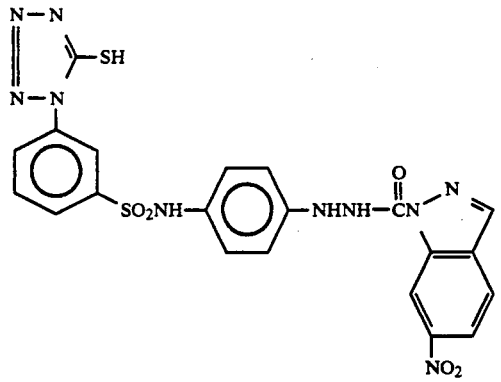
II-42.
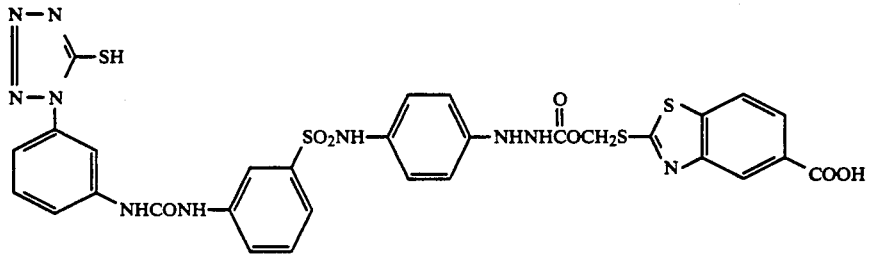
II-43.
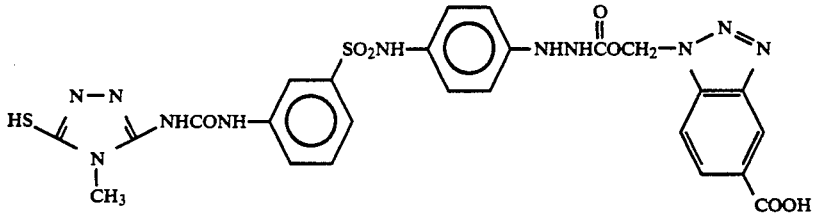
II-44.
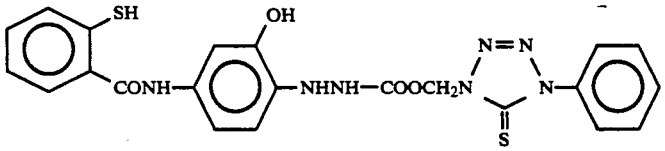
II-45.
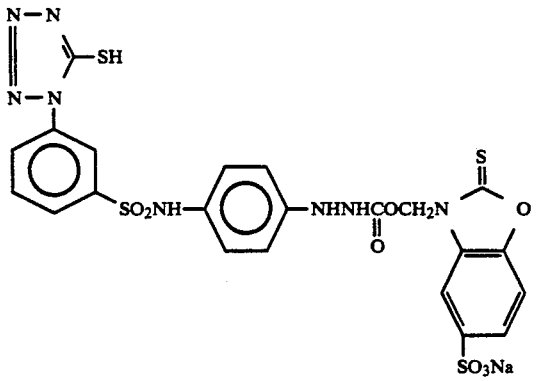

-continued

II-46.

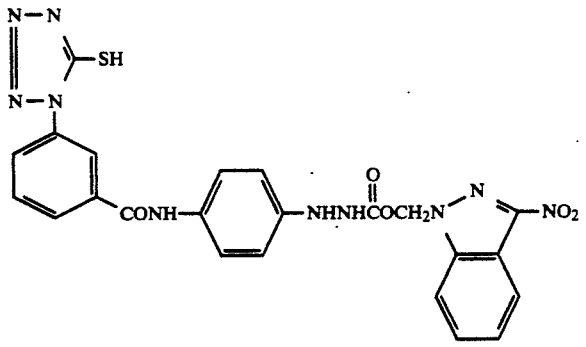

II-47.

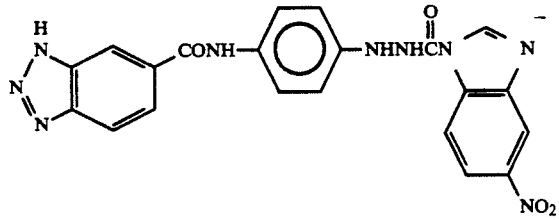

II-48.

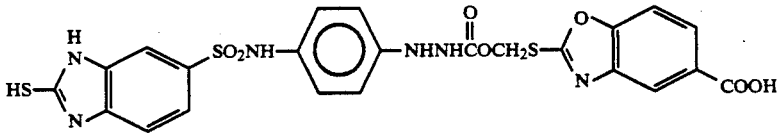

II-49.

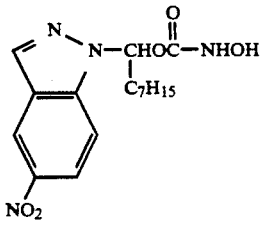

II-50.

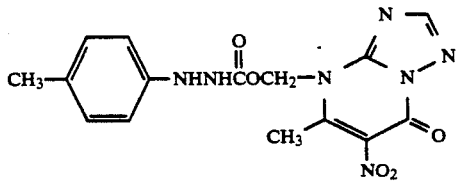

II-51.

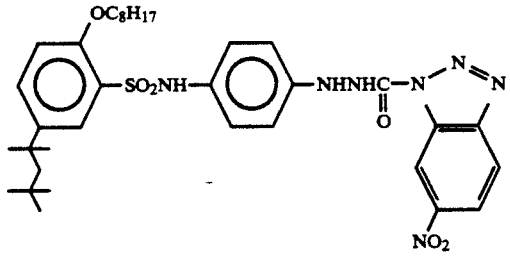

Processes for synthesizing the redox compounds to be used in the present invention are described, for example, in JP-A-61-213847, JP-A-62-260153, U.S. Pat. No. 4,684,604, JP-A-1-269936, U.S. Pat. Nos. 3,379,529, 3,620,746, 4,377,634, 4,332,878, JP-A-49-129536, JP-A-56-153336, and JP-A-56-153342.

The redox compound in accordance with the present invention is used in an amount of about $1\times10^{-5}$ to about $5\times10^{-2}$ mol, more preferably about $2\times10^{-5}$ to about $1\times10^{-2}$ mol, per mol of silver halide.

The redox compound in accordance with the present invention may be used as a solution in a proper water-miscible organic solvent such as an alcohol (e.g., methanol, ethanol, propanol or fluorinated alcohol), a ketone (e.g., acetone or methyl ethyl ketone), dimethylformamide, dimethyl sulfoxide or methyl cellosolve.

Alternatively, the compound may be used according to the well-known emulsifying and dispersing process which comprises dissolving the compound in an oil (e.g., dibutyl phthalate, tricresyl phosphate, glyceryl triacetate or diethyl phthalate) using an auxiliary solvent (e.g., ethyl acetate or cyclohexanone) and preparing an emulsion dispersion in a mechanical manner. Or the compound may be used according to the process known as solid dispersing process which comprises dispersing a powder of the redox compound in water using a ball mill or colloid mill or by applying ultrasonic waves.

The hydrazine derivative, contrast enhancing agent and redox compound in accordance with the present invention can provide a highly contrasty negative image when used in association with a negative working emulsion. On the other hand, they may be used in association with an internal latent image forming silver halide emulsion.

The hydrazine derivative, contrast enhancing agent and redox compound in accordance with the present invention are preferably used in association with a negative working emulsion to form a highly contrasty negative image.

In the case of utilizing them for formation of a highly contrasty image, silver halide grains to be used have preferably a fine average grain size (e.g., 0.7 μm or less), particularly an average grain size of 0.5 μm or less than that. The grains are not fundamentally limited as to grain size distribution, but monodisperse type grains are preferred. The term "monodisperse" as used herein means that at least 95% by weight or number of grains of the grains fall within the range of an average grain size ±40%.

Silver halide grains to be used in the photographic emulsion may be in a regular crystal form such as cubic, octahedral, rhombic dodecahedral or tetradecahedral form, in an irregular form such as spherical or tabular form, or in a composite form thereof.

The silver halide grains may have an inner portion and a surface layer different from, or the same as, each other in phase composition.

In the silver halide emulsion to be used in the present invention, cadmium salts, sulfite salts, lead salts, thallium salts, rhodium salts or complex salts thereof, iridium salts or complex salts thereof, for example, may be present during formation or physical ripening of silver halide grains.

The silver halide to be used in the present invention is silver haloiodide which is prepared by allowing an iridium salt or its complex salt to be present in an amount of $10^{-8}$ to $10^{-5}$ mol per mol of silver and in which the silver iodide content in the surface is greater than the average silver iodide content of the whole grain. The use of an emulsion containing such silver haloiodide provides a higher sensitivity and a higher gamma value.

The silver halide emulsion to be used in the process of the present invention may or may not be chemically sensitized. Examples of processes for chemically sensitizing silver halide emulsions include a sulfur sensitization process, a reduction sensitization process and a noble metal sensitization process. These may be employed alone or in combination for the above described chemical sensitization.

The noble metal sensitization is represented by a gold sensitization process which uses a gold compound, mainly a gold complex salt. Complex salts of noble metals other than gold, such as complex salts of platinum, palladium or rhodium may be incorporated as well. Specific examples thereof are described, for example, in U.S. Pat. No. 2,448,060 and British Patent 618,016. As sulfur sensitizing agents, various sulfur compounds such as thiosulfates, thioureas, thiazoles and rhodanines may be used as well as the sulfur compound contained in gelatin.

In the above described procedure, it is preferable to use an iridium salt or a rhodium salt in the process of preparing the silver halide emulsion before completion of physical ripening, particularly upon formation of the grains.

Regarding the object of the present invention of increasing the maximum density (Dmax), the silver halide emulsion layer in accordance with the present invention preferably contains two kinds of monodisperse emulsions different from each other in average grain size as disclosed in JP-A-61-223734 and JP-A-62-90646, with the smaller sized monodisperse grains being preferably chemically sensitized most preferably by sulfur sensitization. The larger sized monodisperse emulsion may or may not be chemically sensitized. In general, the larger sized monodisperse grains are not chemically sensitized since black peppers have a tendency to be formed and, in the case of conducting chemical sensitization, it is particularly preferable to slightly conduct the chemical sensitization so as not to form black peppers. The term "slightly conduct chemical sensitization" as used herein means to shorten the chemical sensitizing time, decrease the chemical sensitizing temperature or use a smaller amount of the chemical sensitizing agent in comparison with chemical sensitization of the smaller sized grains. Sensitivity difference between the larger sized monodisperse emulsion and the smaller sized monodisperse emulsion is not particularly limited, but is preferably 0.1 to 1.0, more preferably 0.2 to 0.7, in terms of Δlog E, with the larger sized monodisperse emulsion being preferably more sensitive. The sensitivity of each emulsion is a sensitivity obtained by incorporating a hydrazine derivative in the emulsion, coating the emulsion on a support and processing it with a developer of 10.5 to 12.3 in pH containing 0.15 mol/liter or more of sulfite ion. The smaller sized monodisperse emulsion has an average grain size of 90% or less, preferably 80% or less, of that of the larger size monodisperse emulsion. Average grain size of the silver halide emulsion is preferably 0.02 μm to 1.0 μm, more preferably 0.1 μm to 0.5 μm, with the average grain size of the larger sized monodisperse grains and that of the smaller sized monodisperse grains falling preferably in this range.

In using two or more kinds of emulsions different from each other in grain size, the smaller sized monodisperse emulsion be preferably coated in an amount of 40 to 90 wt%, more preferably 50 to 80 wt%, in terms of coated silver amount based on the total coated silver amount.

In the present invention, monodisperse emulsions different from each other in grain size may be introduced into the same emulsion or into different layers. In introducing the emulsions into different layers, the larger sized emulsion is preferably introduced in an upper layer of the photographic material, and the smaller size emulsion in a lower layer of the photographic material.

Additionally, the total coated silver amount is preferably 1 g/m$^2$ to 8 g/m$^2$.

In order to enhance sensitivity, sensitizing dyes described in JP-A-55-52050, pages 45 to 53 (for example, cyanine dyes and merocyanine dyes) may be added to the light-sensitive material to be used in the present invention. These sensitizing dyes may be used alone or as a combination thereof. A combination of sensitizing dyes is often employed for the purpose of supersensitization. Dyes which themselves do not show a spectral sensitizing action or materials which do not substantially absorb visible light, but showing supersensitivity, may be incorporated in the emulsion together with the sensitizing dyes. Useful sensitizing dyes, combinations of dyes showing supersensitivity, and materials showing supersensitivity are described, for example, in *Research Disclosure*, Vol. 176, No. 17643 (December, 1978), page 23, IV, Item J.

Various compounds for preventing fog or stabilizing the photographic properties during production steps, storage, or photographic processing of the light-sensitive material may be incorporated. Many compounds known as antifogging or stabilizing agents such as azoles (e.g., benzothiazolium salts, nitroindazoles, chlorobenzimidazoles, bromobenzimidazoles, mercaptothiazoles, mercaptobenzothiazoles,-mercaptothiadiazoles, aminotriazoles, benzothiazoles, nitrobenzotriazoles, etc.); mercaptopyrimidines; mercaptotriazines; thioketo compounds (e.g., oxazolinethione); azaindenes (e.g., triazaindenes, tetraazaindenes (particularly 4-hydroxy-substituted (1,3,3a,7)tetraazaindenes), pentaazaindenes, etc.); benzenethiosulfonic acids; benzenesulfinic acids; and benzenesulfonamide may be added. Of these, benzotriazoles (e.g., 5-methylbenzotriazole) and nitroindazoles (e.g., 5-nitroindazoles) are particularly preferred. These compounds may be incorporated in a processing solution.

A desensitizing agent may be incorporated in the hydrophilic colloidal layer of the light-sensitive material of the present invention such as photographic emulsion layers.

The organic desensitizing agent to be used in the present invention is a compound which is specified in terms of half wave potential of polarograph, i.e., oxidation reduction potential determined by polarography and which has a polarographic anode potential and a polarographic cathode potential, sum of which is positive. The method of measuring polarographic oxidation reduction potential is described, for example, in U.S. Pat. No. 3,501,307. As the organic desensitizing agents, those which have at least one water-soluble group are preferred. Specific examples thereof include a carboxylic acid group and a sulfonic acid group. These groups may be in salt form with an organic base (e.g., ammonia, pyridine, triethylamine, piperidine or morpholine) or an alkali metal (e.g., sodium or potassium).

As the organic desensitizing agent, suitable examples are represented by formulae (III) to (V) described in JP-A-63-133145.

In the present invention, the organic desensitizing agent is incorporated in the silver halide emulsion layer in an amount of $1.0\times10^{-8}$ to $1.0\times10^{-4}$ mol/m$^2$, particularly $1.0\times10^{-7}$ to $1.0\times10^{-5}$ mol/m$^2$.

The photographic emulsion of the present invention may contain water-soluble dyes as filter dyes or for the purpose of preventing irradiation or for other purposes. As the filter dyes, suitable dyes include those dyes which more extensively decrease photographic sensitivity, preferably ultraviolet ray absorbing agents having a spectral absorption maximum in the intrinsic sensitivity region of silver halide. Additionally, filter dyes having a substantial light absorption range in a wavelength range of substantially from 380 nm to 600 nm may be used for the purpose of enhancing safety to a safelight when light-sensitive materials adapted for bright room processing are involved.

These filter dyes are preferably used by addition to an emulsion layer or to a layer above the silver halide emulsion layer, i.e., a light-insensitive hydrophilic colloidal layer positioned further than the silver halide emulsion layer with respect to the support together with a mordant to fix them, depending upon the purpose.

The ultraviolet ray absorbing agent is added in an amount of usually $10^{-2}$ g/m$^2$ to 1 g/m$^2$, preferably 50 mg to 500 mg/m$^2$, though the precise amount depending upon the molar extinction coefficient of the ultraviolet ray absorbing agent.

The above described ultraviolet ray absorbing agent may be added to a coating solution as a solution in a proper solvent (e.g., water, alcohol (e.g., methanol, ethanol or propanol), acetone, methyl cellosolve or a mixture thereof).

As the ultraviolet ray absorbing agent, suitable compounds include, for example, benzotriazole compounds substituted by an aryl group, 4-thiazolidone compounds, benzophenone compounds, cinnamic acid ester compounds, butadiene compounds, benzoxazole compounds, and ultraviolet ray absorbing polymers.

Specific examples of the ultraviolet ray absorbing agent are described, for example, in U.S. Pat. Nos. 3,533,794, 3,314,794, 3,352,681, JP-A-46-2784, U.S. Pat. Nos. 3,705,805, 3,707,375, 4,045,229, 3,700,455, 3,499,762 and West German Examined Publication No. 1,547,863.

Examples of the filter dyes include oxonol dyes, hemioxonol dyes, styryl dyes, merocyanine dyes, cyanine dyes and azo dyes. From the standpoint of decreasing remaining color, water-soluble dyes or dyes capable of being decolored with alkali or sulfite ion are preferred.

Specifically, there may be used pyrazolone oxonol dyes described in U.S. Pat. No. 2,274,782; diarylazo dyes described in U.S. Pat. No. 2,956,879; styryl dyes and butadienyl dyes described in U.S. Pat. Nos. 3,423,207 and 3,384,487; merocyanine dyes described in U.S. Pat. No. 2,527,583; merocyanine dyes and oxonol dyes described in U.S. Pat. Nos. 3,486,897, 3,652,284 and 3,718,472; enaminohemioxonol dyes described in U.S. Pat. No. 3,976,661; and those dyes which are described in British Patents 584,609 and 1,177,429, JP-A-48-85130, JP-A-49-99620, JP-A-49-114420, U.S. Pat. Nos. 2,533,472, 3,148,187, 3,177,078, 3,247,127, 3,540,887, 3,575,704 and 3,653,905.

The dyes are added to a coating solution for forming the light-insensitive hydrophilic colloidal layer as a solution in a proper solvent (e.g., water, an alcohol (e.g., methanol, ethanol or propanol), acetone, methyl cellosolve or a mixture thereof).

As to specific amount of the dye to be used, a proper amount may be found generally in a range of from $10^{-3}$ g/m$^2$ to 1 g/m$^2$, particularly from $10^{-3}$ g/m$^2$ to 0.5 g/m$^2$.

The photographic material of the present invention may contain inorganic or organic hardening agents in its photographic emulsion layers or other hydrophilic colloidal layers. For example, chromium salts,, aldehydes (e.g., formaldehyde or glutaraldehyde), N-methylol compounds (e.g., dimethylolurea), active vinyl compounds (e.g., 1,3,5-triacryloyl-hexahydro-s-triazine or 1,3-vinylsulfonyl-2-propanol), active halogen compounds (e.g., 2,4-dichloro-6-hydroxy-s-triazine), and mucohalogenic acids; any of which may be used alone or in a combination of two or more thereof.

The photographic material of the present invention may contain various surface active agents in its photographic emulsion layers or other hydrophilic colloidal layers for various purposes, e.g., as a coating aid, for preventing lubricating properties, for emulsifying or dispersing, for preventing adhesion and for improving the photographic properties (for example, acceleration of development, enhancement of contrast or sensitization), inter alia. Surface active agents which are particularly preferred in the present invention are polyalkylene oxides described in JP-B-58-9412 (the term "JP-B" as used herein refers to an "examined Japanese patent publication") and having a molecular weight of 600 or more. In the case of using them as antistatic agents, fluorine-containing surface active agents (detailed descriptions being given in U.S. Pat. No. 4,201,586, JP-A-60-80849 and JP-A-59-74554) are particularly preferred.

The photographic light-sensitive material of the present invention may contain in its photographic emulsion layers or other hydrophilic colloidal layers matting agents such as silica, magnesium oxide and polymethyl methacrylate for the purpose of preventing adhesion.

The photographic emulsion of the present invention may contain a dispersion of a water-insoluble or slightly water-soluble synthetic polymer. For example, polymers may be used which contain monomeric components such as alkyl (meth)acrylates, alkoxyacryl (meth-)acrylates and glycidyl (meth)acrylates alone or in combination, or those containing a combination of these components and acrylic acid, methacrylic acid, or the like.

The photographic light-sensitive material of the present invention preferably contains an acid group-containing compound in its silver halide emulsion layers or other hydrophilic colloidal layers. As the acid group-containing compound, examples include organic acids such as salicylic acid, acetic acid and ascorbic acid and polymers or copolymers containing as repeating units acid monomers such as acrylic acid, maleic acid or phthalic acid. As to these compounds, reference may be made to JP-A-61-223834, JP-A-61-228437, JP-A-62-25745 and JP-A-62-55642. Of these acid group-containing compounds, ascorbic acid is particularly preferred as a low molecular compound, and a water-dispersible latex of a copolymer composed of an acid monomer such as acrylic acid and a crosslinking monomer having two or more unsaturated groups such as divinylbenzene is particularly preferred as a high molecular compound.

In obtaining photographic ultra-contrasty properties and a high sensitivity using the silver halide light-sensitive material of the present invention, it is not necessary to use a conventional infectious developer or a highly alkaline developer having a pH as high as nearly 13 such as described in U.S. Pat. No. 2,419,975, and the light-sensitive material permits the use of a stable developer.

That is, the silver halide photographic material of the present invention permits the use of a developer containing 0.15 mol/liter or more sulfite ion as a preservative and having a pH of 10.5 to 12.3, particularly 11.0 to 12.0, for obtaining a sufficiently ultra-contrasty negative image.

The developing agents to be used in the present invention are not particularly limited, but in view of the ease of obtaining good halftone dot quality, dihydroxybenzenes are preferred. In some cases, a combination of a dihydroxybenzene and a 1-phenyl-3-pyrazolidone or a combination of a dihydroxybenzene and a p-aminophenol may be employed. The developing agent is used in an amount of preferably 0.05 mol/liter to 0.8 mol/liter. In the case of using the combination of a dihydroxybenzene and a 1-phenyl-3-pyrazolidone, or the combination of a dihydroxybenzene and a p-aminophenol, it is preferred to use the former in an amount of 0.05 mol/liter to 0.5 mol/liter and the latter in an amount of 0.06 mol/liter or less.

As the preservative of sulfite salt to be used in the present invention, examples include sodium sulfite, potassium sulfite, lithium sulfite, ammonium sulfite, sodium bisulfite, potassium metabisulfite and formaldehyde-sodium bisulfite adduct. The sulfite salt is used in an amount of 0.4 mol/liter or more, particularly preferably 0.5 mol/liter or more.

The developer of the present invention may contain the compounds described in JP-A-56-24347 as silver stain preventing agents. As dissolving aids to be added to the developer, those compounds which are described in JP-A-61-267759 may be used. Further, those compounds which are described in JP-A-60-93433 and those compounds which are described in JP-A-62-186259 may be used as pH buffers for the developer.

The hydrazine derivative, contrast enhancing agent and redox compound in accordance with the present invention may be used in association with a negative working emulsion to prepare a highly contrasty light-sensitive material and, in addition, may be associated with an internal latent image forming silver halide emulsion. The latter embodiment will be described below. In this case, the hydrazine derivative, contrast enhancing agent and redox compound are preferably incorporated in the internal latent image forming emulsion layer, but may be incorporated in a hydrophilic colloidal layer adjacent to the internal latent image forming silver halide emulsion layer. Such layer may be a layer with any function such as a colorant layer, an interlayer, a filter layer, a protective layer or an antihalation layer, as long as a nucleating agent is not prevented from diffusing into silver halide grains.

The amounts of hydrazine derivatives, contrast enhancing agent and redox compound in the layer vary depending upon the properties of silver halide emulsion used, chemical structure of the nucleating agent and developing conditions and therefore proper amounts vary over a wide range. From a practical point of view, however, amounts of each compound of from about 0.005 mg to about 500 mg per mol of silver in the internal latent image forming silver halide emulsion are useful, with amounts of about 0.01 mg to about 100 mg per mol of silver being particularly preferred. In the case of incorporating them in a hydrophilic colloidal layer adjacent to the emulsion layer, they are used in the same amounts as described above based on the amount of silver contained in the same area of the internal latent image forming emulsion. Definition of the internal latent image forming silver halide emulsion is given in JP-A-61-170733, page 10, upper column, and British Patent 2,089,057, pages 18 to 20.

Preferred internal latent image forming emulsions to be used in the present invention are described in JP-A-61-253716, page.28, line 14 to page 31, line 2, and preferred silver halide grains are described in JP-A-61-253716, page 31, line 3 to page 32, line 11.

In the light-sensitive material of the present invention, the internal latent image forming emulsion may be spectrally sensitized to a light of comparatively long wavelength of a blue light, green light, red light or infrared light using a sensitizing dye. As the sensitizing dyes, there may be used, for example, cyanine dyes, merocyanine dyes, complex cyanine dyes, complex merocyanine dyes, holopolar cyanine dyes, styryl dyes, hemicyanine dyes, oxonol dyes and hemioxonol dyes. Such sensitizing dyes include those cyanine dyes and merocyanine dyes which are described, for example, in JP-A-59-40638, JP-A-59-40636 and JP-A-59-38739.

The light-sensitive material of the present invention may contain color image forming couplers as color forming materials, or may be developed with a developer containing color image forming couplers.

Specific examples of these cyan, magenta and yellow couplers to be used in the present invention are described in the patent cited in *Research Disclosure* (*RD*), 17643 (December, 1978), Item VII-D and ibid., 18717 (November, 1979).

Couplers which can form color dyes with suitable diffusibility, non-color forming couplers, DIR couplers capable of releasing a development inhibitor upon coupling reaction, or couplers capable of releasing a development promotor may also be used.

Typical examples of yellow couplers to be used in the present invention include oil protected acylacetamide couplers.

In the present invention, the use of 2-equivalent yellow couplers is preferred, and typical examples thereof include yellow couplers of oxygen atom coupling-off type or nitrogen atom coupling-off type. α-Pivaloylacetanilide type couplers are excellent in fastness, particularly light fastness, of formed color dyes, whereas α-benzoylacetanilide type couplers provide a high coloration density.

Magenta couplers to be used in the present invention include oil protected indazolone or cyanoacetyl couplers, preferably 5-pyrazolone couplers and pyrazoloazole couplers (e.g., pyrazolotriazole couplers). Of the 5-pyrazolone couplers, those which are substituted by an arylamino group or an acylamino group at the 3-position are preferred in view of hue and coloration density of colored dyes.

As coupling-off groups for 2-equivalent 5-pyrazolone couplers, nitrogen atom coupling-off groups described in U.S. Pat. No. 4,310,619 and arylthio groups described in U.S. Pat. No. 4,351,897 are particularly preferred. 5-Pyrazolone couplers having a ballast group, such as described in European Patent 73,636, provide high coloration density.

As pyrazoloazole couplers, examples include pyrazolobenzimidazoles described in U.S. Pat. No. 3,379,899, preferably pyrazolo[5,1−c][1,2,4]triazoles described in U.S. Pat. No. 3,725,067, pyrazolotetrazoles described in *Research Disclosure*, 24220 (June, 1984), and pyrazolopyrazoles described in *Research Disclosure*, 24230 (June, 1984). Imidazo[1,2−b]pyrazoles described in European Patent 119,741 are preferred in the instance of a small side yellow absorption and light fastness of formed dyes, and pyrazolo[1,5−b][1,2,4]triazoles described in European Patent 119,860 are particularly preferred.

Cyan couplers to be used in the present invention include oil protected naphtholic and phenolic couplers. Typical examples thereof include naphtholic couplers described in U.S. Pat. No. 2,474,293, and preferably, oxygen atom coupling-off 2-equivalent naphtholic couplers described in U.S. Pat. Nos. 4,052,212, 4,146,396, 4,228,233 and 4,296,200. Specific examples of the phenolic couplers are described, for example, in U.S. Pat. Nos. 2,369,929, 2,801,171, 2,772,162, 2,895,826. Cyan couplers capable of forming dyes fast against high humidity and high temperature are preferably used in the present invention, and typical examples thereof include phenolic cyan couplers having an alkyl group containing two or more carbon atoms at the meta-position of the phenol nucleus and being described in U.S. Pat. No. 3,772,002, 2,5-diacylamino-substituted phenolic couplers and phenolic couplers having a phenylureido group in the 2-position and an acylamino group in the 5-position.

In order to eliminate unnecessary absorption in a shorter wavelength region of dyes formed from the magenta and cyan couplers, colored couplers are preferably used together in color light-sensitive materials for photographic use.

Graininess can be improved by using those couplers which form dyes with a proper diffusibility. As such couplers forming diffusible dyes, U.S. Pat. No. 4,366,237 and British Patent 2,125,570 describe specific examples of magenta couplers, and European Patent 96,570 and West German Patent (OLS) No. 3,234,533 describe specific examples of yellow, magenta or cyan couplers.

The dye-forming couplers and the above described couplers which form diffusible dyes may form polymers having a polymerization degree of two or more. Typical examples of polymerized dye-forming couplers are described in U.S. Pat. Nos. 3,451,820 and 4,080,211. Specific examples of polymerized magenta couplers are described in British patent 2,102,173 and U.S. Pat. No. 4,367,282.

Two or more of the various couplers to be used in the present invention may be used in the same light-sensitive layer, or the same compound may be used in two or more layers for obtaining photographic properties required for light-sensitive materials.

The standard amount of the color coupler ranges from 0.001 to 1 mol per mol of light-sensitive silver halide, more preferably 0.01 to 0.5 mol per mol silver halide with respect to yellow couplers, 0.003 to 0.3 mol per mol silver halide with respect to magenta couplers, and 0.02 to 0.3 mol per mol silver halide with respect to cyan couplers.

In the present invention, developing agents such as hydroxybenzenes (e.g., hydroquinones), aminophenols and 3-pyrazolidones may be incorporated in an emulsion or in a light-sensitive material.

The photographic emulsion to be used in the present invention may be associated with dye image providing compounds (color forming materials) for a color diffusion transfer process capable of releasing a diffusible dye in conformity with development of silver halide for obtaining a desired transfer image in an image receiving layer after proper development processing. As such color forming materials for color diffusion transfer process, many conventional compounds are recognized. Above all, those which are first nondiffusible but, upon oxidation reduction reaction with an oxidation product of a developing agent (or an electron transfer agent), undergo cleavage to release a diffusible dye (hereinafter referred to as "DRR compounds") are preferably used.

In particular, DRR compounds having an N-substituted sulfamoyl group are preferred. It is o-hydroxyarylsulfamoyl group-having DRR compounds described in U.S. Pat. Nos. 4,055,428, 4,053,312 and 4,336,322 and DRR compounds having a redox nucleus and being described in JP-A-53-149328 that are preferable for the combined use with the nucleating agent of the present invention. The combined use of these DRR compounds markedly decreases temperature dependence upon processing.

After imagewise exposure, the light-sensitive material of the present invention is preferably subjected to a fogging processing with the nucleating agent and, after or during this processing, is subjected to color development using a surface developer of 11.5 or less in pH containing an aromatic primary amine color developing agent, followed by bleach-fixing processing to obtain a direct positive color image. The color developer has a pH of preferably 11.0 to 10.0.

In the fogging processing employed in the present invention, suitable techniques include either of the so-called "photo-fogging process" of giving a second exposure to the whole surface of the light-sensitive layer or the so-called "chemically fogging process" of developing in the presence of a nucleating agent. Development may be conducted in the presence of both the nucleating agent and the fogging light. Alternatively, a light-sensitive material containing a nucleating agent may be exposed for fogging.

The photo-fogging process is described in JP-A-63-108336, and JP-A-63-108336 also describes the nucleating agents to be used in the present invention, with use of the compounds represented by formulae (N-1) and (N-2) therein being preferred. As specific examples thereof, nucleating agents (N-I-1) to (N-I-10) described in JP-A-63-108336, as well as (N-II-1) to (N-II-12) described therein are preferably used.

Nucleation promoting agents to be used in the present invention are also described in JP-A-63-108336. As specific examples thereof, (A-1) to (A-13) described therein are preferably used.

The color developer to be used in development processing of the light-sensitive material of the present invention is also described in JP-A-63-108336. As specific examples of the aromatic primary amine color developing agents, p-phenylenediamine compounds are preferred, and typical examples thereof include 3-methyl-4-amino-N-ethyl-N-(β-methanesulfonamidoethyl-)aniline, 3-methyl-4-amino-N-ethyl-N- -hydroxyethyl-)aniline, 3-methyl-4-amino-N-ethyl-N-methoxyethylaniline, and salts thereof, such as sulfates, hydrochlorides, inter alia.

In forming a direct positive color image using the light-sensitive material of the present invention according to the color diffusion transfer process, black-and-white developing agents such as phenidone derivatives may be used as well as the above described color developing agents.

The color developed photographic emulsion layers are usually bleached. Bleaching may be conducted independently or simultaneously with fixing (bleach-fixing). In order to promote processing, bleach-fixing may be conducted after bleaching, or bleach-fixing may be conducted after fixing. As bleaching agents for the bleaching solution or bleach-fixing solution in accordance with the present invention, iron aminopolycarboxylate complex salts are usually used. As additives to be used in the bleaching solution or bleach-fixing solution in accordance with the present invention, various compounds described in JP-A-62-215272 may be used. After the desilvering step (bleach-fixing or fixing), washing is conducted with water and/or stabilizing. For the water washing step or the stabilizing solution, softened water is preferably used. As processes for softening water, there are illustrated processes of using ion exchange resins described in JP-A-62-288838 or using a reverse osmosis apparatus. Specific processes thereof are described in JP-A-62-288838.

Further, as additives to be used in the water washing step and the stabilizing step, various compounds described in JP-A-62-215272 may be used.

As to the amounts of replenishers in respective processing steps, smaller amounts are better, and are preferably 0.1 to 50 times, more preferably 3 to 30 times, as much as the amount of the solution entrained from the prebath per unit area of the light-sensitive material.

The present invention is now illustrated in greater detail by reference to the following examples which, however, are not to be construed as limiting the present invention in any way. Unless otherwise indicated herein, all parts, percents, ratios and the like are by weight.

EXAMPLE 1

Preparation of Light-Sensitive Emulsion

A silver nitrate aqueous solution and an aqueous solution of potassium iodide and potassium bromide were simultaneously added to a gelatin aqueous solution maintained at 50° C. in 60 minutes in the presence of $4\times10^{-7}$ mol of potassium hexachloroiridate(III) per mol of silver and in the presence of ammonium, during which pAg was kept at 7.8. Thus, there was prepared a cubic monodisperse emulsion having an average grain size of 0.28 μm and an average silver iodide content of 0.3 mol%. This emulsion was then subjected to a flocculation process to desalt and, after adding thereto 40 g of inert gelatin per mol of silver, was maintained at 50° C. Then, a sensitizing dye of 5,5'-dichloro-9-ethyl-3,3'-bis(3-sulfopropyl)oxacarbocyanine and $10^{-3}$ mol per mol of silver of a KI solution were added thereto and, after 15 minutes, the temperature was decreased to 10° C.

Coating of the Light-Sensitive Emulsion Layer

The emulsion was redissolved and, at 40° C., the following hydrazine derivatives were added thereto.

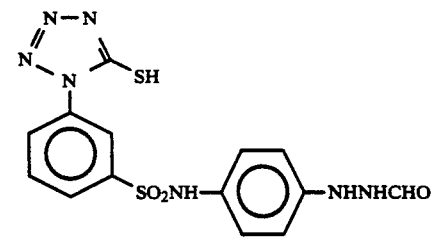

0.9 mg/m²

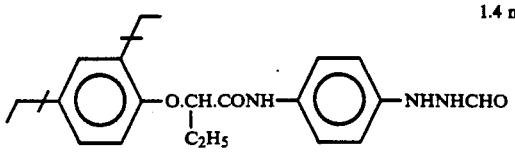

1.4 mg/m²

Furthermore, a contrast enhancing agent and a redox compound as shown in Table 1 below were added thereto, and 5-methylbenzotriazole, 4-hydroxy-1,3,3a,7-tetraazaindene and 30 wt%, based on gelatin, of polyethyl acrylate, and a gelatin hardener of the compound shown below were added to the emulsion. Then, the resulting emulsion was coated in a silver amount of 3.8 g/m$^2$ on a polyethylene terephthalate film (150 μm) having a subbing layer (0.5 μm) comprising a vinylidene chloride copolymer.

Gelatin Hardener

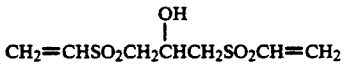

2.0 wt% based on gelatin

Coating of Protective Layer

On this emulsion layer was coated a protective layer comprising 1.5 g/m$^2$ of gelatin, 0.3 g/m$^2$ of polymethyl methacrylate particles (average particle size: 2.5 μm), and 0.3 g/m$^2$ of Ag of AgCl fine particles (0.08 μm) prepared according to the following process using the following surfactants.

Surfactants

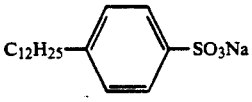

37 mg/m$^2$

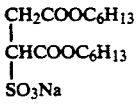

37 mg/m$^2$

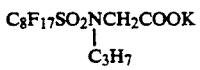

2.5 mg/m$^2$

Evaluation of Properties

These samples were exposed to a 3,200° K. tungsten light through an optical wedge and a contact screen (made by Fuji Photo Film Co., Ltd.; 150L chain dot type), then developed with Developer I described below for 30 seconds at 34° C., fixed, washed with water, and dried.

Results of examining the halftone dot quality and halftone gradation of the samples are tabulated in Table 1. Halftone gradation was presented by the following formula:

Gradation ($\overline{G}$): The slope of the line drawn on the characteristic curve between the point of 0.3 in density and the point of 3.0 in density. A larger value represents a more contrasty property.

* Halftone Gradation $\Delta\log E$ = [exposure amount giving a halftone dot area of 95% (log $E$ 95%)] − [exposure amount giving a halftone dot area of 5% (log $E$ 5%)]

Halftone dot quality was visually scored in five grades wherein "5" stands for the best result and "1" the worst result. As a halftone dot original plate for making printing plate, samples scored "5" or "4" are practically usable, samples scored "3" are at a practically limitative level, and samples scored "2" or "1" are practically unusable. Results thus obtained are tabulated in Table 1.

| Developer I: | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)-benzenesulfonate | 0.2 g |
| N-n-Butyldiethanolamine | 15.0 g |
| Sodium Toluenesulfonate | 8.0 g |
| Water to make | 1 liter |
| KOH to adjust pH to | 11.5 |

As can be seen from the results shown in Table 1, the samples in accordance with the present invention demonstrate a markedly enhanced contrast and improved halftone dot quality in comparison with the comparative samples. In addition, the samples in accordance with the present invention showed a markedly broad halftone gradation and improved halftone dot quality while maintaining substantially the same contrasty properties.

TABLE 1

| | Redox Compound | | Contrast Enhancing Agent | | Photographic Properties | | |
|---|---|---|---|---|---|---|---|
| Sample No. | Type | Added Amount (mol/Ag mol) | Type | Added Amount (mol/Ag mol) | $\overline{G}$ | Halftone Gradation | Halftone Dot Quality |
| 1 (Comparison) | — | — | A-5 | $8.0 \times 10^{-5}$ | 13.5 | 1.21 | 4 |
| 2 (Comparison) | II-17 | $5.7 \times 10^{-4}$ | — | — | 7.6 | 1.40 | 3 |
| 3 (Comparison) | II-38 | " | — | — | 8.5 | 1.39 | 3 |
| 4 (Comparison) | II-41 | $8.6 \times 10^{-5}$ | — | — | 9.1 | 1.38 | 3 |
| 1-1 (Invention) | II-17 | $5.7 \times 10^{-4}$ | A-1 | $8.0 \times 10^{-5}$ | 14.3 | 1.39 | 5 |
| 1-2 (Invention) | " | " | A-5 | " | 12.5 | 1.39 | 4 |
| 1-3 (Invention) | " | " | A-12 | $3.0 \times 10^{-5}$ | 17.1 | 1.40 | 5 |
| 1-4 (Invention) | II-38 | " | A-1 | $8.0 \times 10^{-5}$ | 14.7 | 1.39 | 5 |
| 1-5 (Invention) | II-41 | $8.6 \times 10^{-5}$ | " | " | 15.0 | 1.39 | 5 |
| 1-6 (Invention) | II-17 | $5.7 \times 10^{-4}$ | A-8 | $3.0 \times 10^{-5}$ | 13.3 | 1.42 | 4 |
| 1-7 (Invention) | " | " | A-17 | " | 14.5 | 1.40 | 5 |
| 1-8 (Invention) | II-19 | " | A-12 | " | 15.1 | 1.38 | 5 |
| 1-9 (Invention) | II-27 | " | " | " | 14.0 | 1.39 | 5 |
| 1-10 (Invention) | II-35 | " | " | " | 13.8 | 1.42 | 4 |
| 1-11 (Invention) | II-42 | $8.6 \times 10^{-5}$ | A-12 | $3.0 \times 10^{-5}$ | 13.5 | 1.42 | 4 |

TABLE 1-continued

| Sample No. | Redox Compound Type | Redox Compound Added Amount (mol/Ag mol) | Contrast Enhancing Agent Type | Contrast Enhancing Agent Added Amount (mol/Ag mol) | Photographic Properties $\overline{G}$ | Photographic Properties Halftone Gradation | Photographic Properties Halftone Dot Quality |
|---|---|---|---|---|---|---|---|
| 1-12 (Invention) | II-45 | " | " | " | 14.2 | 1.39 | 5 |
| 1-13 (Invention) | II-46 | " | " | " | 14.7 | 1.40 | 5 |
| 1-14 (Invention) | II-51 | $5.7 \times 10^{-4}$ | A-5 | $8.0 \times 10^{-5}$ | 14.4 | 1.45 | 5 |

EXAMPLE 2

Evaluation was conducted in the same manner as in Example 1 except for using Developer II prepared by omitting N-n-butyldiethanolamine from Developer I used in Example 1. As a result, the samples in accordance with the present invention gave highly contrasty property and good halftone dot quality similar to those observed in Example 1 as shown in Table 2.

| Developer II | |
|---|---|
| Hydroquinone | 50.0 g |
| N-Methyl-p-aminophenol | 0.3 g |
| Sodium Hydroxide | 18.0 g |
| 5-Sulfosalicylic Acid | 55.0 g |
| Potassium Sulfite | 110.0 g |
| Disodium Ethylenediaminetetraacetate | 1.0 g |
| Potassium Bromide | 10.0 g |
| 5-Methylbenzotriazole | 0.4 g |
| 2-Mercaptobenzimidazole-5-sulfonic Acid | 0.3 g |
| Sodium 3-(5-Mercaptotetrazole)-benzenesulfonate | 0.2 g |
| Sodium Toluenesulfonate | 8.0 g |
| Water to make | 1 liter |
| KOH to adjust pH to | 11.5 |

Of the comparative samples, Comparative Sample 1 provided contrasty properties, but Comparative Samples 2 to 4 gave $\overline{G}$ value as low as 5 to 7, thus failing to provide enough contrasty properties.

In addition, photographic properties were examined as to the samples of the present invention having been processed with Developer II and Comparative Sample 1 having been processed with fatigued Developers I and II.

Samples prepared in the same manner as in Example 1 were exposed in the same manner as in Example 1. Then, Developer I and Developer II were loaded in a plate-making automatic developing machine, Model FG660F (made by Fuji Photo Film Co., Ltd.), and the samples were developed under the following three conditions at 34° C. for 30 seconds, then fixed, washed with water, and dried.

(A) Development was conducted immediately after the temperature of the developer loaded in the automatic developing machine reached 34° C. (Development with a fresh developer)

(B) Development was conducted after leaving the developer in the automatic developing machine for 4 days. (Development with an air fatigued developer)

(C) After loading the developer in the automatic developing machine, 50.8 cm×61.0 cm GRANDEX GA-100 film made by Fuji Photo Film Co., Ltd. having been exposed so that 50% of the film was to be developed was processed at a rate of 200 sheets a day and, after processing 5 days, the samples were developed by this developer. 100 cc of Developer I or II was replenished per sheet. (Development with a developer fatigued by mass processing)

The photographic properties thus obtained are tabulated in Table 2. In view of running stability of the processing, photographic properties obtained by processing under conditions (B) or (C) preferably would not be different from the photographic properties obtained by processing under condition (A).

TABLE 2

| Sample No. | Photographic Properties $\overline{G}$ | Photographic Properties Halftone Dot Quality | Photographic Properties Halftone Gradation | Running Stability of Processing: Developer I Air Fatigued Developer ($\Delta S_{B-A}$*) | Developer I Developer Fatigued by Mass Processing ($\Delta S_{C-A}$*) | Developer II Air Fatigued Developer ($\Delta S_{B-A}$*) | Developer II Developer Fatigued by Mass Processing ($\Delta S_{C-A}$*) |
|---|---|---|---|---|---|---|---|
| 1-1 (Invention) | 12.9 | 5 | 1.42 | +0.10 | −0.12 | +0.03 | −0.10 |
| 1-2 (Invention) | 10.5 | 4 | 1.42 | +0.07 | −0.14 | +0.04 | −0.10 |
| 1-3 (Invention) | 13.2 | 5 | 1.43 | +0.06 | −0.10 | +0.03 | −0.09 |
| 1-4 (Invention) | 12.7 | 4 | 1.40 | +0.08 | −0.11 | +0.03 | −0.10 |
| 1-5 (Invention) | 13.5 | 4 | 1.41 | +0.07 | −0.09 | +0.03 | −0.08 |
| 1-6 (Invention) | 12.1 | 5 | 1.43 | +0.09 | −0.10 | +0.04 | −0.09 |
| 1-7 (Invention) | 13.0 | 5 | 1.42 | +0.10 | −0.12 | +0.04 | −0.10 |
| 1-8 (Invention) | 13.4 | 4 | 1.41 | +0.09 | −0.10 | +0.03 | −0.09 |
| 1-9 (Invention) | 12.7 | 4 | 1.43 | +0.10 | −0.11 | +0.05 | −0.10 |
| 1-10 (Invention) | 12.5 | 5 | 1.45 | +0.08 | −0.09 | +0.03 | −0.08 |
| 1-11 (Invention) | 12.0 | 5 | 1.44 | +0.07 | −0.09 | +0.03 | −0.08 |
| 1-12 (Invention) | 12.8 | 4 | 1.40 | +0.06 | −0.08 | +0.03 | −0.07 |
| 1-13 (Invention) | 13.3 | 5 | 1.41 | +0.08 | −0.09 | +0.04 | −0.08 |
| 1-14 (Invention) | 13.1 | 5 | 1.46 | +0.08 | −0.09 | +0.04 | −0.08 |
| 1 (Comparison) | 11.1 | 4 | 1.25 | +0.19 | −0.24 | +0.15 | −0.23 |

The samples of the present invention demonstrated a more improved running stability of processing when used in conjunction with Developer II.

While the invention has been described in detail and with reference to specific embodiments thereof, it will be apparent to one skilled in the art that various changes and modifications can be made therein without departing from the spirit and scope thereof.

What is claimed is:

1. A silver halide photographic material, which comprises a support having thereon at least one light-sensitive emulsion layer, and which contains in said emulsion layer or at least one other layer (i) at least one hydrazine derivative, (ii) at least one contrast enhancing agent which is an amine derivative, an onium derivative, a disulfide derivative or a hydroxymethyl derivative, and (iii) at least one redox compound which is represented by the following formula (II):

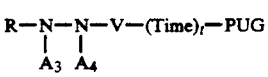

(II)

wherein $A_3$ and $A_4$ both represent a hydrogen atom, or one of $A_3$ and $A_4$ represents a hydrogen atom and the other represents a sulfinic acid residue or

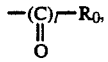

wherein $R_0$ represents an alkyl group, an alkenyl group, an aryl group, an alkoxy group or an aryloxy group, l represents 1 or 2, Time represents a divalent linking group, t represents 0 or 1, PUG represents a development inhibitor, V represents a carbonyl group,

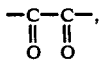

a sulfonyl group, a sulfoxy group

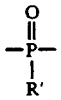

(wherein R′ represents an alkoxy group or an aryloxy group), an imino-methylene group or a thiocarbonyl group, and R represents an aliphatic group, an aromatic group or a heterocyclic group.

2. The silver halide photographic material in claim 1, wherein said hydrazine derivative is represented by the following formula (I):

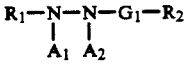

(I)

wherein $R_1$ represents an aliphatic group or an aromatic group; $R_2$ represents a hydrogen atom, an alkyl group, an aryl group, an alkoxy group, an aryloxy group, an amino group, a carbamoyl group or an oxycarbonyl group; $G_1$ represents a carbonyl group, a sulfonyl group, a sulfoxy group,

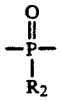

or an iminomethylene group; and $A_1$ and $A_2$ both represent a hydrogen atom, or one of $A_1$ and $A_2$ represents a hydrogen atom and the other represents an alkylsulfonyl group, an arylsulfonyl group, or an acyl group.

3. The silver halide photographic material in claim 1, wherein said amine derivative has a group capable of promoting adsorption onto silver halide grains.

4. The silver halide photographic material in claim 1, wherein said amine derivative contains a total of 20 or more carbon atoms.

5. The silver halide photographic material in claim 1, wherein said onium salt is an ammonium salt or a phosphonium salt.

6. The silver halide photographic material in claim 1, wherein said hydroxymethyl derivative is a diarylmethanol derivative.

* * * * *